US007152262B2

(12) United States Patent
Ikeda et al.

(10) Patent No.: US 7,152,262 B2
(45) Date of Patent: Dec. 26, 2006

(54) MATTRESS APPARATUS

(75) Inventors: Shigeru Ikeda, Kunitachi (JP); Yoshio Oguma, Tokyo (JP); Yukihiko Takaishi, Hachioji (JP)

(73) Assignee: France Bed Co., Ltd., Tokyo (JP)

( * ) Notice: Subject to any disclaimer, the term of this patent is extended or adjusted under 35 U.S.C. 154(b) by 0 days.

(21) Appl. No.: 11/192,658

(22) Filed: Jul. 29, 2005

(65) Prior Publication Data

US 2005/0257319 A1 Nov. 24, 2005

Related U.S. Application Data

(63) Continuation of application No. PCT/JP04/00490, filed on Jan. 21, 2004.

(30) Foreign Application Priority Data

Feb. 5, 2003 (JP) ..... 2003-028758
Feb. 25, 2003 (JP) ..... 2003-048049

(51) Int. Cl.
*A61G 7/00* (2006.01)

(52) U.S. Cl. ..... 5/618; 5/657; 5/722

(58) Field of Classification Search ..... 5/613, 5/617–619, 722, 657, 660
See application file for complete search history.

(56) References Cited

U.S. PATENT DOCUMENTS 5,791,001 A 8/1998 Wang

FOREIGN PATENT DOCUMENTS

| | | | |
|---|---|---|---|
| JP | 11-9391 | A | 1/1999 |
| JP | 2000-152852 | A | 6/2000 |
| JP | 2001-137075 | A | 5/2001 |
| WO | WO 96/12427 | A1 | 5/1996 |

OTHER PUBLICATIONS

English translation of Written Opinion of the International Searching Authority (Form PCT/ISA/237) issued in International Application No. PCT/JP2004/000490 filed Jan. 21, 2004.

*Primary Examiner*—Patricia Engle
*Assistant Examiner*—Fredrick Conley
(74) *Attorney, Agent, or Firm*—Frishauf, Holtz, Goodman & Chick, P.C.

(57) ABSTRACT

A fixed rod member is provided integrally with at least both sides of the lateral direction of the periphery of a bendable spring unit. A hinge mechanism is provided at the end portion of the fixed rod member. The hinge mechanism is connected by a movable rod member provided integrally with the periphery of at least one end portion of the spring unit. Thus, one end portion of the spring unit is configured to be bent together with the movable rod member.

11 Claims, 15 Drawing Sheets

MATTRESS APPARATUS

CROSS REFERENCE TO RELATED APPLICATIONS

This is a Continuation Application of PCT Application No. PCT/JP2004/000490, filed Jan. 21, 2004, which was published under PCT Article 21(2) in Japanese.

This application is based upon and claims the benefit of priority from prior Japanese Patent Applications No. 2003-028758, filed Feb. 5, 2003; and No. 2003-048049, filed Feb. 25, 2003, the entire contents of both of which are incorporated herein by reference.

BACKGROUND OF THE INVENTION

1. Field of the Invention

The present invention relates to a mattress apparatus used for a bed.

2. Description of the Related Art

A mattress apparatus used for a bed has a rectangular plate-shaped spring unit or a cushion body such as a foamed elastic body, which is covered with an exterior cloth.

A user lying on his (her) back on a mattress apparatus may read a book or watch a TV. It is easier to read a book or watch a TV by raising the head a little from a horizontal state.

A conventional mattress apparatus does not hold the user's head in a raised state. Thus, the user must use a cushion under a pillow to raise the head. However, this state is unstable and tiring.

A known bed used with a mattress apparatus has a floor plate divided into several parts to place a mattress apparatus, so that the user can raise the upper part of the body. This is so-called a rising-floor type bed. A rising-floor type bed permits the user to sit up on the bed by raising a part of the floor plate.

However, a rising-floor type bed requires a mechanism to drive a part of the floor plate. The driving mechanism included in a bed complicates the configuration and increases the cost. The bed becomes large as a result.

The present invention provides a mattress apparatus which is configured to raise the user's head with a simple structure.

BRIEF SUMMARY OF THE INVENTION

According to the present invention, there is provided a mattress apparatus in which the user can place a head on the upper surface of one end portion of the longitudinal direction, comprising:

a bendable cushion body;

a fixed rod member provided integrally with at least both sides of the periphery of the cushion body;

a hinge mechanism having a pair of fitting parts connected movably and held at a specified angle, in which one fitting part is fixed to the end portion of the fixed rod member;

a movable rod member which is connected to the other fitting part of the hinge mechanism and provided integrally with the periphery of at least one end portion of the cushion body, and bends at least one end portion of the cushion body when moved and raised by the hinge mechanism; and an exterior cloth which covers the cushion body.

DETAILED DESCRIPTION OF THE INVENTION

Embodiments of the present invention will be explained hereinafter with reference to the accompanying drawings.

Figure 1:
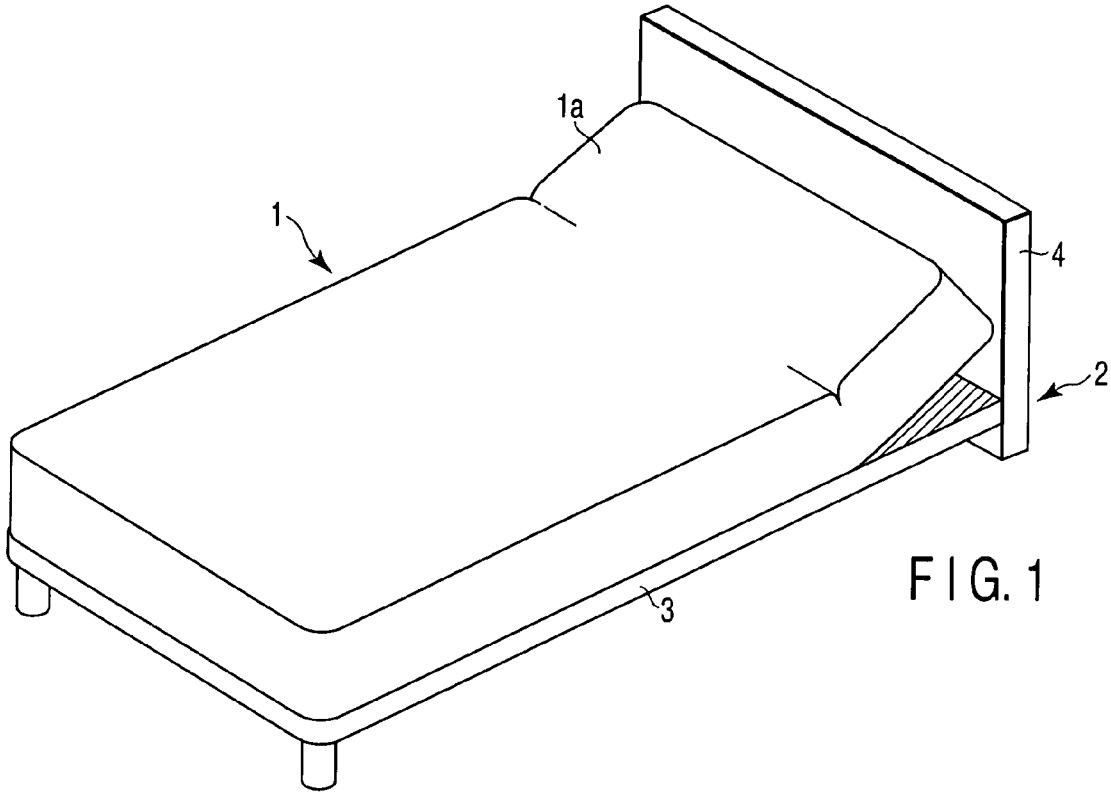
FIG. 1 is a perspective view of a bed using a mattress apparatus according to a first embodiment of the present invention.

FIGS. 1 to 6 show a first embodiment of the invention. FIG. 1 is a perspective view showing the state that a mattress apparatus 1 is placed on a floor plate 3 of a bed 2. One end portion 1*a* of the mattress apparatus 1 put on the headboard 4 side of the bed can be raised and held at a specified angle.

Figure 2:
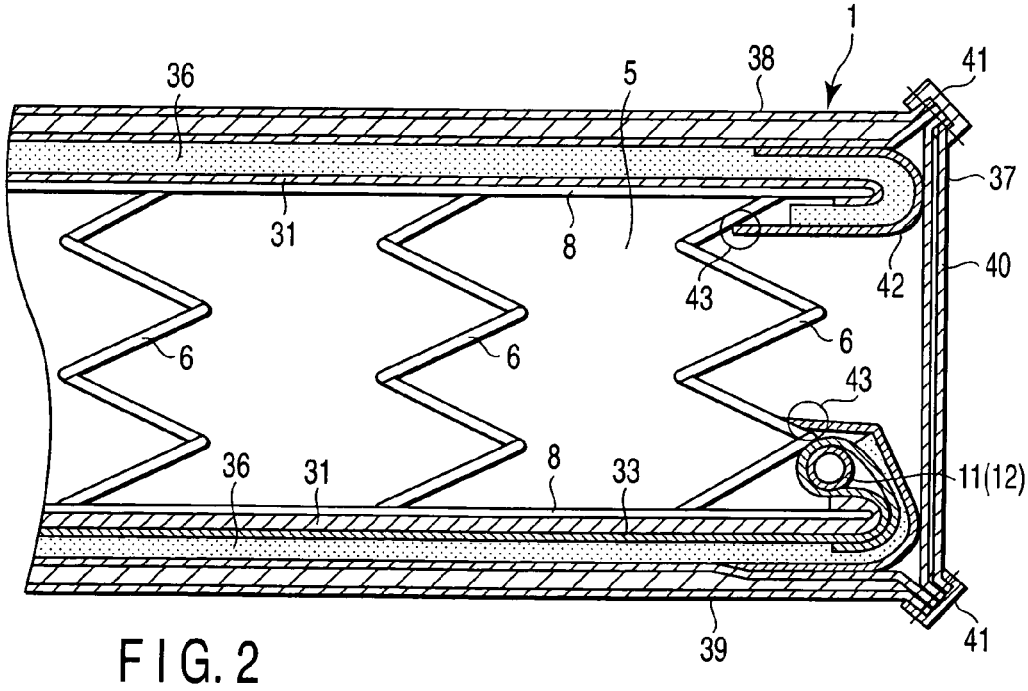
FIG. 2 is a sectional view showing a part of the mattress apparatus.

The mattress apparatus 1 has a spring unit 5 as a cushion body as shown in FIG. 2. The spring unit 5 is formed as a rectangular plate with rows of many drum-shaped coil springs 6 as shown in FIG. 2 and FIGS. 4A–4C.

Figure 4A:
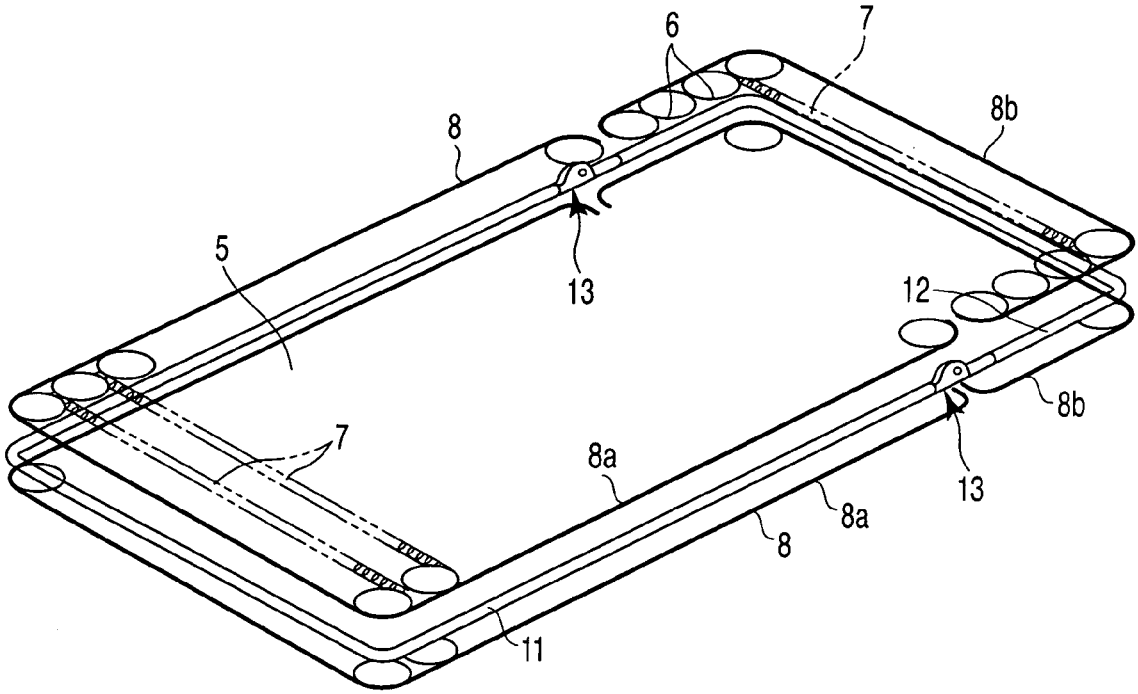
FIG. 4A is a perspective view showing a simplified configuration of a spring unit.
Figure 4B:
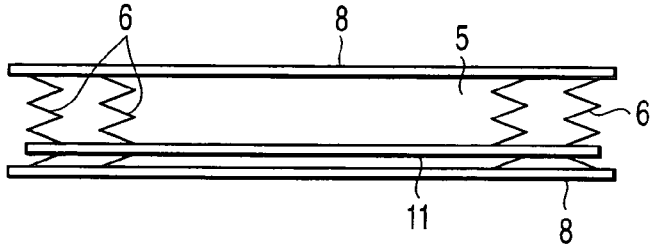
FIG. 4B is a side view of a spring unit.

The upper end face and lower end face of the coil springs 6 adjacent along the longitudinal direction of the spring unit 6 are connected by a helical wire 7 provided along the lateral direction. FIG. 4A shows only the helical wire connecting the upper end face.

A frame wire 8 is fastened to the peripheral edge portions of the upper and lower surfaces of the spring unit 5 by a clip not shown. The frame wire 8 is divided into a first portion 8*a* and a second portion 8*b* at one end of the longitudinal direction on both sides of the lateral direction of the spring unit 5. The first and second portions 8*a* and 8*b* are shaped substantially U-shaped, thereby the spring unit 6 can be bent at the part where the frame wire 8 is divided.

The helical wire 7 may be provided along the longitudinal direction of the spring unit 5. The part of the frame wire divided into the first and second portions 8*a* and 8*b* may be connected by a member made of soft synthetic resin or rubber, for example a tube-shaped member.

In the periphery of the spring unit 5, a U-shaped fixed rod member 11 corresponding to the first portion 8*a* of the frame wire 8 and a U-shaped movable rod member 12 corresponding to the second portion 8*b* are provided integrally with the spring unit 5 by a holding means to be described later.

The fixed rod member 11 and movable rod member 12 are made of pipe. The both ends placed on both sides of one end portion of the spring unit 5 are connected by a hinge mechanism 13 movably and held at a certain angle.

Figure 3:
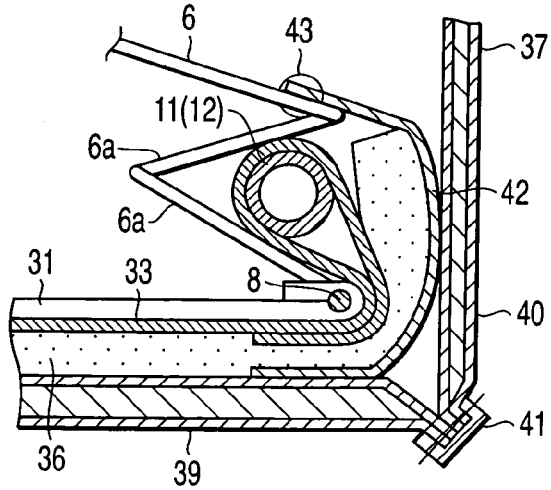
FIG. 3 is a magnified sectional view showing a means of holding a fixed rod member and a movable rod member in a spring unit.

The fixed rod member 11 and movable rod member 12 connected with the hinge mechanism 13 are shaped rectangular a little smaller than the shape of the plane of the spring unit 5. Thus, the fixed rod member 11 and movable rod member 12 provided in the periphery of the spring unit 5 are inserted into the middle part of the axial direction of the spring of the coil spring 6 placed in the periphery of the spring unit 5, or between the spiral windings 6*a* at the lower end portion in this embodiment as shown in FIG. 2 and FIG. 3, and are held together with the spring unit 6.

The hinge mechanism 13 has a first arm 17 and a second arm 18 as fitting members, with one ends attached to a pivot 16. The other end of the first arm 17 is fit into and fixed to the end portion of the movable rod member 12. The end portion of the second arm 18 is fit into and fixed to the end portion of the fixed rod member 11.

Teeth 19 are formed at one end of the first arm 17. A stopper 21 to engage with the teeth 19 is pivotally attached to one end of the second arm 18 by a pin 22. The stopper 21 is energized in the direction to engage with the teeth 19 by a spring 23.

A cam plate 24 is movably attached to the pivot 16. A concave 25 and a convex 26 are formed at a specified angle in the direction of the circumference of the periphery of the cam plate 24. The radius of the convex 26 from the pivot 16 is made larger than the radius of the teeth 19 from the pivot 16. At one end of the first arm 17, an engagement body 27 placed in the concave 25 is provided in the state that the stopper 21 engages with the teeth 19.

Thus, the first arm 17 can be held at a specified rotation angle against the second arm 18 by the engagement of the stopper 21 and teeth 19. The stopper 21 rides on the convex 26 of the cam plate 24 and disengages from the teeth 19, by moving the first arm 17 in the direction indicated by the arrow in FIG. 6 and interlocking the cam plate 24 with this movement by the engagement body 27 contacting one end of the concave 25. Then, the first arm 17 can be freely moved in the direction reverse to the arrow.

The first arm 17 can be moved in the direction reverse to the arrow, until the engagement body 27 contacts the other end of the concave 25 and moves the cam plate 24, and the stopper 21 disengages from the convex 26 of the cam plate 24 and engages with the teeth 19, that is, until the first arm 17 becomes substantially horizontal against the second arm 18.

Therefore, the movable rod member 12 can be raised and held by the hinge mechanism 13 at a specified angle against the fixed rod member 11, and can also be laid flat.

Figure 5:
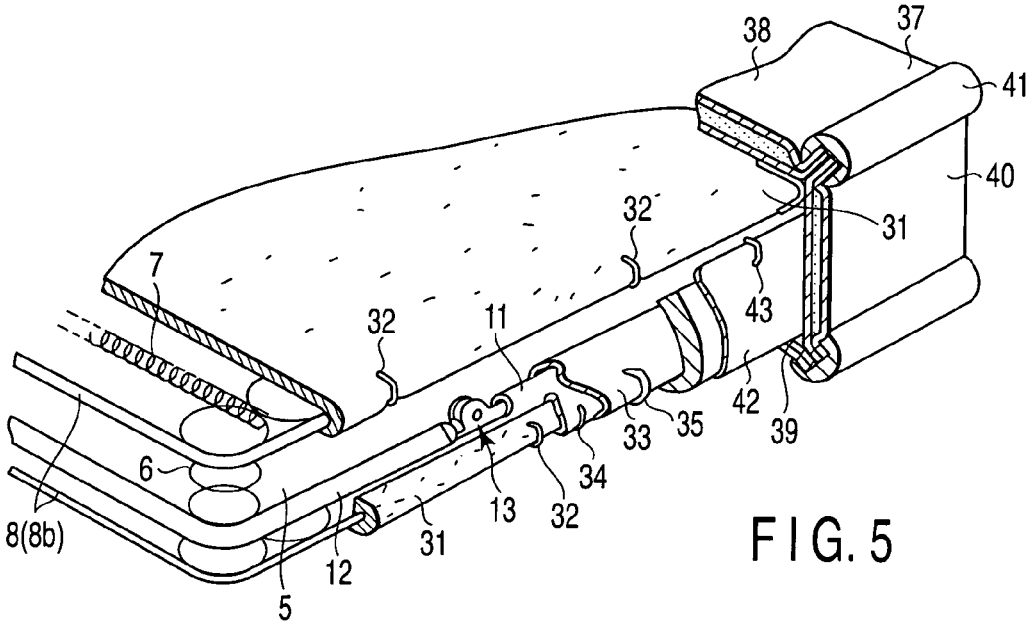
FIG. 5 is a partially broken away perspective view of the structure for holding a fixed rod member and a movable rod member in a spring unit.
Figure 6:
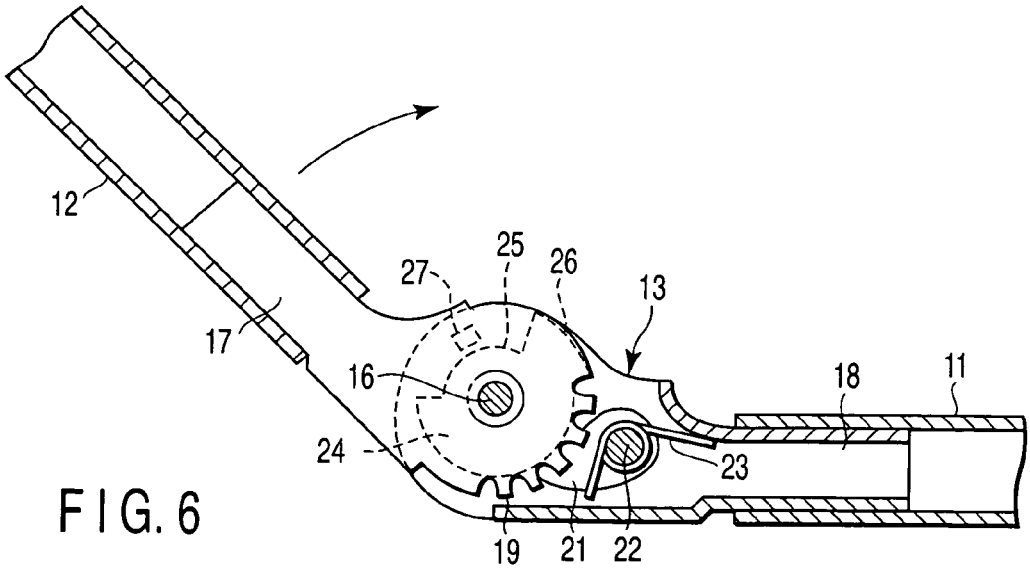
FIG. 6 is a partially sectional side view of a hinge mechanism.

As shown in FIG. 2 and FIG. 5, felt 31 is provided all over the upper and the lower surfaces of the spring unit 5. The peripheral edge portion of the felt 31 is wound around the frame wire 8, and the bent part is fastened to the frame wire 8 with a clip 32.

The felt 31 laid on the lower surface of the spring unit 5 is provided with a holding cloth 33 that constitutes a holding means. The holding cloth 33 is shaped rectangular sufficiently larger than the shape of the plane of the spring unit 5, and the periphery is extended outward from the periphery of the spring unit 5.

The periphery of the holding cloth 33 extended from the periphery of the spring unit 5 is wound from the internal to external circumference around the fixed rod member 11 and movable rod member 12 provided in the periphery of the spring unit 5, as shown in FIG. 2 and FIG. 3, and returned to the periphery on the lower surface of the spring unit 5.

As shown in FIG. 5, the part of the holding cloth 33 toward the internal circumferences of the rod members 11 and 12 is connected and fixed by a first clip 34 to the frame wire 8 of the lower side together with the end portion of the felt 31. The part bent from the internal to external circumference is connected and fixed by a second clip 35 to the frame wire 8 together with the part of the internal circumference. Thus, the fixed rod member 11 and movable rod member 12 are fastened together to the spring unit 5 by the periphery of the holding cloth 33.

As the fixed rod member 11 and movable rod member 12 are fastened together to the spring unit 5, when the movable rod member 12 is turned at a specified angle against the fixed rod member 11, the part of the spring unit 5 corresponding to the movable rod member 12 can be bent at a specified angle against the part corresponding to the fixed rod member 11. Further, as the peripheral edge portion of the holding cloth 33 is wound around the rod members 11 and 12, a "clunk" sound is prevented when the rod members 11 and 12 bump against the coil spring 6.

The fixed rod member 11 and movable rod member 12 form a U-shape and surround the three sides of the spring unit 5. Thus, the spring unit 5 is prevented from twisting in the lateral direction by the fixed rod member 11 and movable rod member 12. Especially, when the movable rod member 12 is raised and one end portion of the spring unit 5 is bent upward, the bent portion of the spring unit 5 becomes easy to twist in the lateral direction, but the twist can be surely prevented by the movable rod member 12.

The fixed rod member 11 and movable rod member 12 are engaged between windings 6*a* of the coil spring 6 placed in the periphery of the spring unit 5. Thus, these rod members 11 and 12 are engaged and fastened together to the spring unit 5 without using the holding cloth 33, and one end portion of the spring unit 5 corresponding to the movable rod member 12 can be bent interlocking with the rotation of the movable rod member 12.

An elastic sheet 36 made of urethane foam is laid on the felt 31 on the upper surface of the spring unit 5 and the holding cloth 33 on the lower surface. The layered body is covered with an exterior cloth 37.

The exterior cloth 37 consists of an upper surface cloth 38 covering the upper surface of the spring unit 5, a lower surface cloth 39 covering the lower surface, and a side cloth 40 covering the peripheral surface. The surface cloths 37/38 and side cloth 40 have a 3-layer structure with an elastic sheet inserted between the front and back cloths. The peripheral edge portions of the surface cloths 38 and 39 are stitched together to the upper and lower ends of the side cloth 40 with a tape edge 41.

One end of the lateral direction of a belt-shaped flange cloth 42 is stitched to the peripheries of the back cloths of the surface cloths 38 and 39. The other end of the lateral direction of the flange cloth 42 is connected to the winding 6*a* of the coil spring 6 placed in the periphery of the spring unit 5 by a clip 43, involving the periphery of the elastic sheet 36. This prevents shifts of the exterior cloth 37 relative to the spring unit 5.

In the mattress apparatus 1, the fixed rod member 11 and movable rod member 12 are provided in the periphery of the spring unit 5 by engaging between the windings 6*a* of the coil spring 5, and these rod members 11 and 12 are fastened together to the spring unit 5 by the holding cloth 33. The fixed rod member 11 and movable rod member 12 are connected with the hinge mechanism 13 movably and held at a specified angle.

Figure 4C:
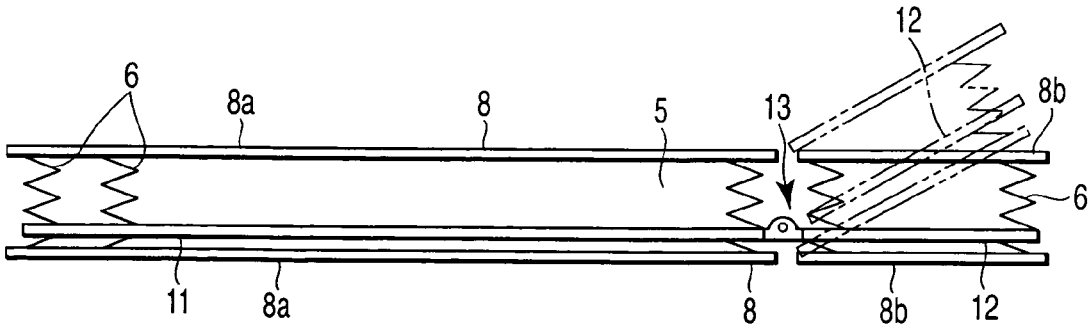
FIG. 4C is a front view of a spring unit.

Thus, when the movable rod member 12 is moved in the rising direction relative to the fixed rod member 11 from the state indicated by the solid line in FIG. 4C and held at a specified angle as indicated by the chain line, one end portion of the spring unit 5 corresponding to the movable rod member 12 can be bent interlocking with the movement of the movable rod member 12 as indicated by the chain line.

When one end portion of the spring unit 5 is bent by the movable rod member 12, one end portion 1*a* of the mattress apparatus 1 can be raised and held at a specified angle as shown in FIG. 1.

Figure 14A:
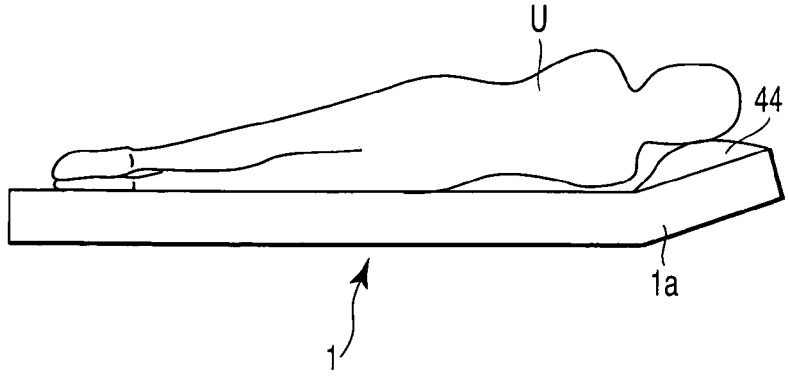
FIGS. 14A–14C are explanatory drawings of usage of a mattress apparatus according to the present invention.
Figure 14B:
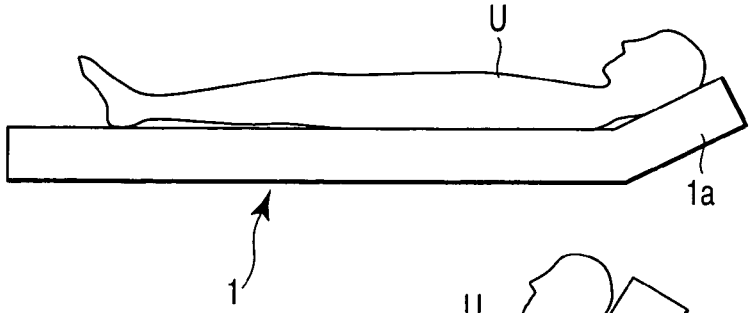

As shown in FIG. 14B, the user U lying on his (her) back on the upper surface of the mattress apparatus 1 can easily hold the position with the head raised a little, and the user can read a book or watch a TV in the position lying on his (her) back.

When the user U lies on his (her) side on the mattress apparatus 1 using a pillow 44 as shown in FIG. 14A, the user can take the position without turning the head to the left or right against the backbone by raising one end portion 1*a* of the mattress apparatus 1, and the user can easily keep the position lying on his (her) side without putting a load on the neck.

As described above, one end portion 1*a* of the mattress apparatus 1 can be raised and held at a specified angle by the movable rod member 12. As one end portion of the mattress apparatus 1 is raised, the mattress apparatus 1 can be configured simply at a low price compared with raising the floor plate 3 of the bed 2 by the driving mechanism for raising the floor plate.

Further, in the mattress apparatus 1, the spring unit 5 is covered with the exterior cloth 37, and the fixed rod member 11, movable rod member 12 and hinge mechanism 13 for bending one end portion of the spring unit 5 is not seen from the outside. The rod members 11 and 12 are inserted between the windings 6*a* of the coil spring 6 placed in the periphery of the spring unit 5, and not projected outward from the periphery of the mattress apparatus 1.

Though one end portion can be bent, the appearance of the mattress apparatus 1 is the same as an ordinary mattress apparatus, and has a very good appearance. The mattress apparatus can be used with either upper or lower side up.

Figure 7:
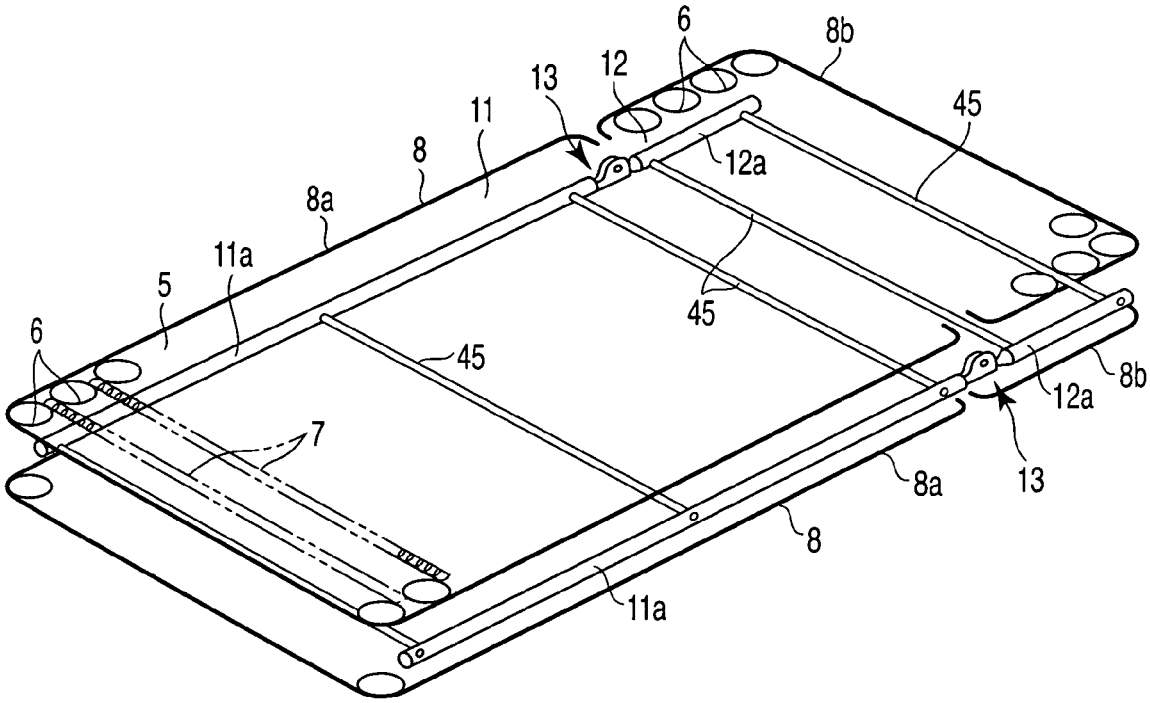
FIG. 7 is a perspective view showing a simplified configuration of a spring unit according to a second embodiment of the present invention.

FIG. 7 is a second embodiment showing modifications of the fixed rod member 11 and movable rod member 12 of the first embodiment. In this embodiment, each of the fixed rod member 11 and movable rod member 12 consists of a pair of straight rod 11*a* and 12*a*. The end portions of the straight rods 11*a* and 12*a* are connected by the hinge mechanism 13. The connected straight rod 11*a* and 12*a* are engaged between the windings 6*a* of the coil spring 6 placed on both sides of the lateral direction of the spring unit 5.

The pairs of straight rods 11*a* and 12*a* placed on both sides of the lateral direction of the spring unit 5 are connected by a connection member 45 such as a round rod provided along the lateral direction of the spring unit 5, and fastened together to the sprint unit 5. Namely, the connection member 45 is a holding means in this embodiment.

Even with this configuration, a part of the spring unit 5 corresponding to the pair of straight rods 12*a* of the movable rod member 12 of the spring unit 5 can be bent and raised interlocking with the straight rod 12*a* by moving and raising the pair of straight rods 12*a* of the movable rod member 12 by the hinge mechanism 13 at a specified angle against the pair of straight rods 11*a* of the fixed rod member 11. Namely, the fixed rod member 11 and movable rod member 12 may not be U-shaped and may be a straight rod.

Instead of the connection member 45, a holding means may be a binding member such as a wire or cord to bind the straight rods 11*a* and 12*a* to the winding 6*a* of the coil spring 6 placed in the periphery of the spring unit 5.

Figure 8:
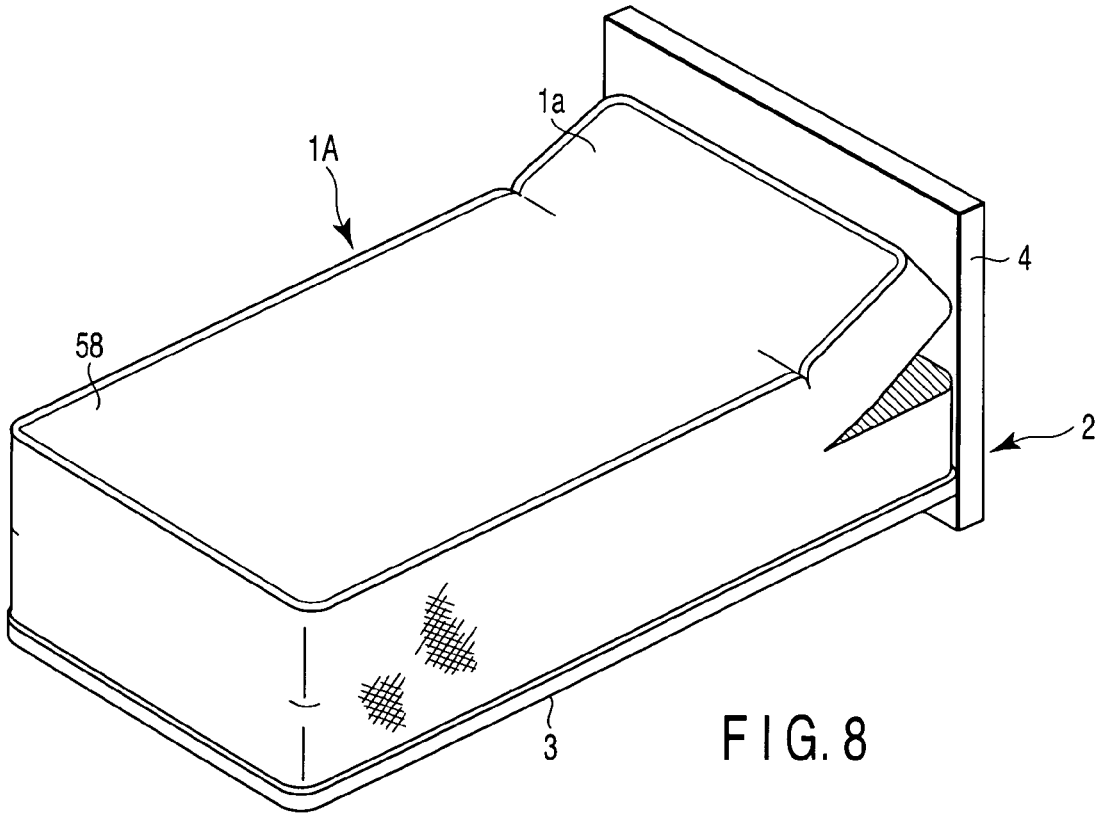
FIG. 8 is a perspective view of a bed using a mattress apparatus according to a third embodiment of the present invention.
Figure 9:
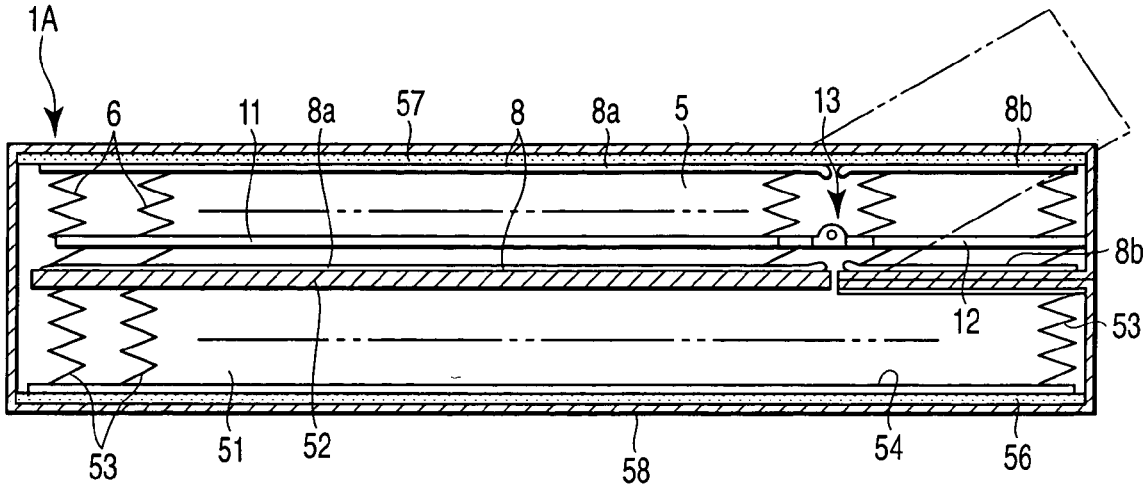
FIG. 9 is a sectional view of the mattress apparatus shown in FIG. 8.
Figure 10:
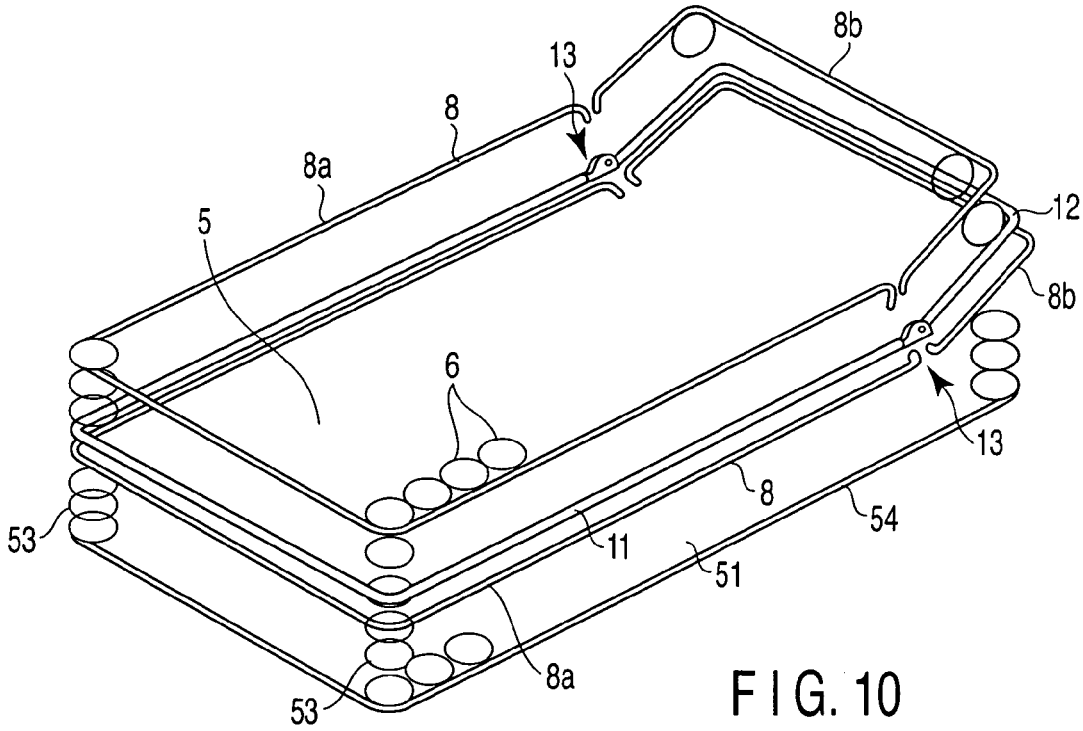
FIG. 10 is a perspective view of a spring unit used in the mattress apparatus shown in FIG. 9.

FIG. 8 to FIG. 10 show a third embodiment of the invention. A mattress apparatus 1A of this embodiment is a double-cushion type to increase the cushion efficiency. Namely, the mattress apparatus 1A has a spring unit 5 of the same configuration as the first embodiment. The spring unit 5 is laid on the upper surface of a bottom spring unit 51 as a bottom cushion body through a sheet-like partition member 52 such as felt. The partition member 52 is provided at one end portion of the longitudinal direction of the spring units 5 and 51, or at the part except the portion corresponding to the movable rod member 12 of the spring unit 5.

The bottom spring unit 51 has rows of many coil springs 53. The upper and lower end faces of the coil springs 53 adjacent in the longitudinal direction are connected by a helical wire (not shown) along the lateral direction crossing the longitudinal direction. A frame wire 54 is provided in the periphery of the lower surface.

The frame wire 8 provided in the periphery of the lower surface of the spring unit 5 serves also as a frame wire in the periphery of the upper surface of the bottom spring unit 51, and is divided into two portions 8*a* and 8*b* as in the first embodiment.

In one portion 8*a* of the lower side frame wire 8 of the spring unit 5, the upper end face of the coil spring 53 placed in the periphery of the bottom spring unit 51 is fastened together with the peripheral edge portion of the partition member 52 by a clip (not shown).

A lower elastic sheet 56 is laid on the lower surface of the bottom spring unit 51, and an upper elastic sheet 57 is laid on the upper surface of the spring unit 5. This layered unit is covered with an exterior cloth 58.

At one end portions of the longitudinal direction of the two layered spring units 5 and 51, or the portion bent by the movable rod member 12 of the spring unit 5, the exterior cloth 58 covers separately the upper side spring unit 5 and lower side bottom spring unit 51. Namely, at one end portion of the layered body, the spring unit 5 is covered with the exterior cloth 58 not only in the upper surface but also in the lower surface, and the bottom spring unit 51 is covered not only in the lower surface but also in the upper surface.

Therefore, in this configuration, one end portion 1*a* of the mattress apparatus 1A can be raised and held at a specified angle as shown in FIG. 8. At this time, the spring unit 5 and bottom spring unit 51 located at one end portion 1*a* of the mattress apparatus 1A are separately covered with the exterior cloth 58, and the lower surface of the spring unit 5 and the upper surface of the bottom spring unit 51 are not exposed at all. This provides a very good appearance.

Figure 11:
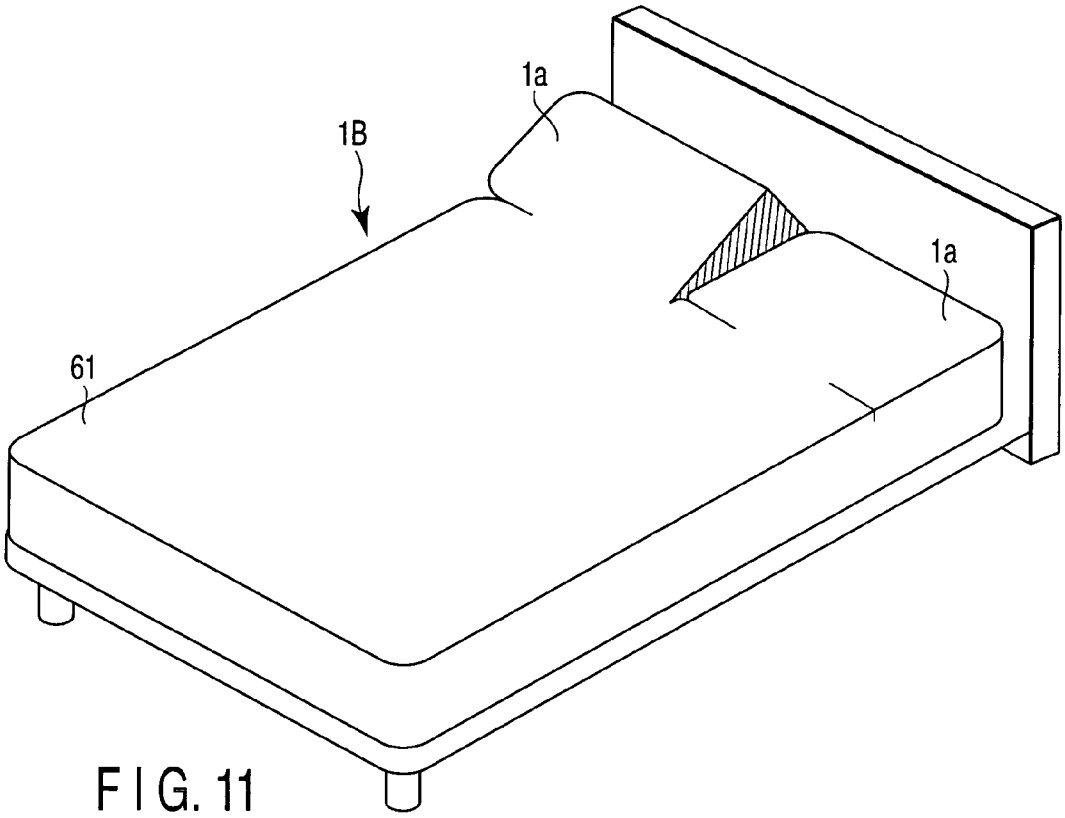
FIG. 11 is a perspective view of a bed using a mattress apparatus according to a fourth embodiment of the present invention.
Figure 12:
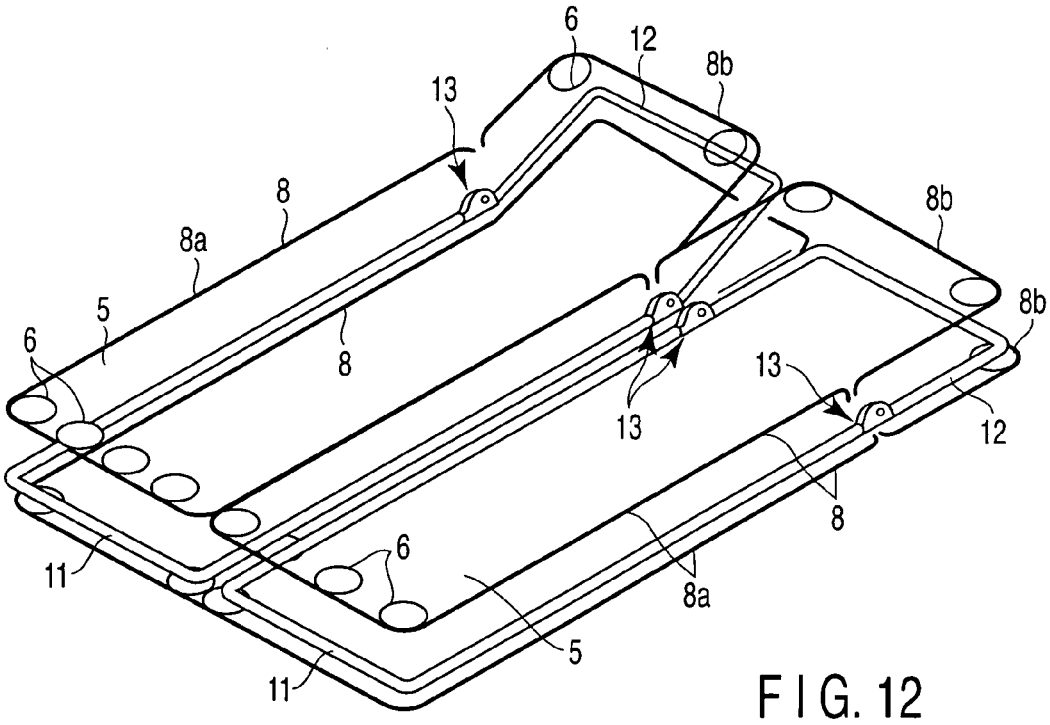
FIG. 12 is a perspective view of a spring unit used in the mattress apparatus shown in FIG. 11.

FIG. 11 and FIG. 12 show modifications of a mattress apparatus 1B according to a fourth embodiment of the invention. In the mattress apparatus 1B of this embodiment, two spring units 5 shown in the first embodiment are provided side by side, and covered with an exterior cloth 61. Namely, the mattress apparatus 1B is a double size.

A pair of one end portions 1*a* of the mattress apparatus 1B, or the portions bent by the movable rod members 12 of two spring units 5, are covered separately by the exterior cloth 61 to be bent independently.

Thus, only one end portion 1*a* of the mattress apparatus 1B can be selectively moved and raised. Further, when only one end portion 1*a* is turned and raised, the internal structures of that one end portion 1*a* and the other end portion 1*b* are not exposed to the outside. This provides a good appearance.

Figure 13A:
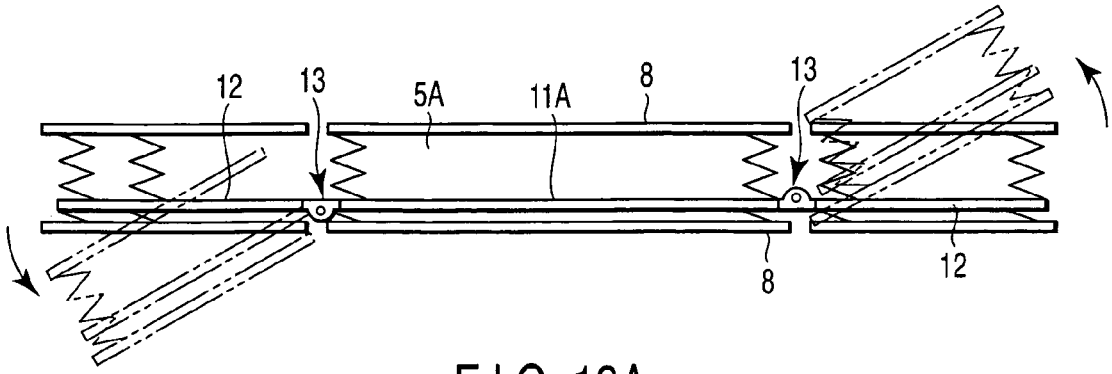
FIGS. 13A–13C are side views of a spring unit according to a fifth embodiment of the present invention.
Figure 13B:
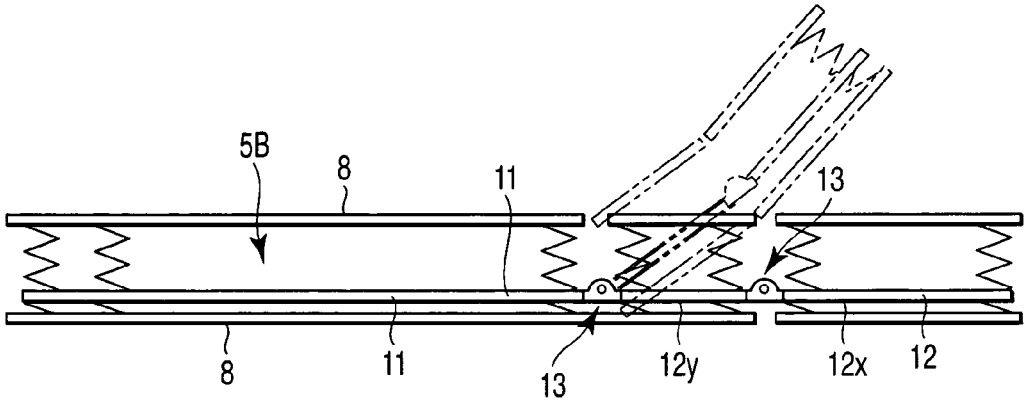
Figure 13C:
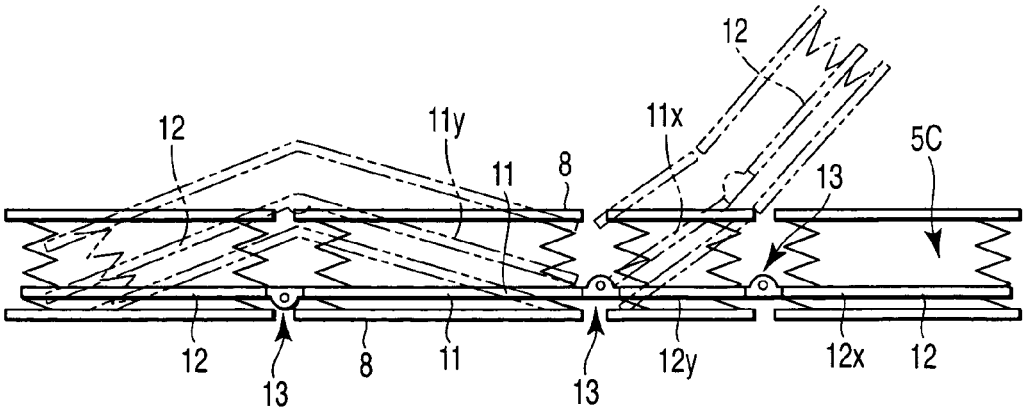

FIGS. 13A–13C show modifications of a spring unit according to a fourth embodiment of the invention. In the spring unit 5A shown in FIG. 13A, one end portion and the other end portion of the longitudinal direction can be bent by the movable rod member 12.

Namely, a fixed rod member 11A is a straight rod. At one end and the other end of the fixed rod member, a U-shaped movable rod member 12 is connected by the hinge mechanism 13 movably and held at a specified angle. One of the movable rod members 12 and the other movable rod member 12 are connected by the hinge mechanism 13 set upside down, so that the rods are turned reversely as indicated by the arrow in the same drawings.

The frame wire 8 is divided at the portions corresponding to both ends of the straight fixed rod member 11A not to disturb the bending of both ends of the spring unit 5 by the movable rod member 12.

As one end and the other end of the spring unit 5A can be bent up and down reversely as described above, the user's head can be raised and held by bending one end upward even when the spring unit 5A is used with either one side or the other side faced up.

FIG. 13B shows a modification of the spring unit of the first embodiment. One end portion of the spring unit 5B of this embodiment can be bent in two steps. Namely, the movable rod member 12 provided in the periphery of the spring unit 5B is divided into several portions in the middle part placed on both sides of the spring unit 5B, two portions 12*x* and 12*y* in this embodiment.

The divided two portions 12*x* and 12*y* are sequentially connected to the end portion of the fixed rod member 11 by the hinge mechanism 13. The hinge mechanism 13 is provided to bend the two portions 12*x* and 12*y* of the movable rod member 12 in the same direction.

Figure 14C:
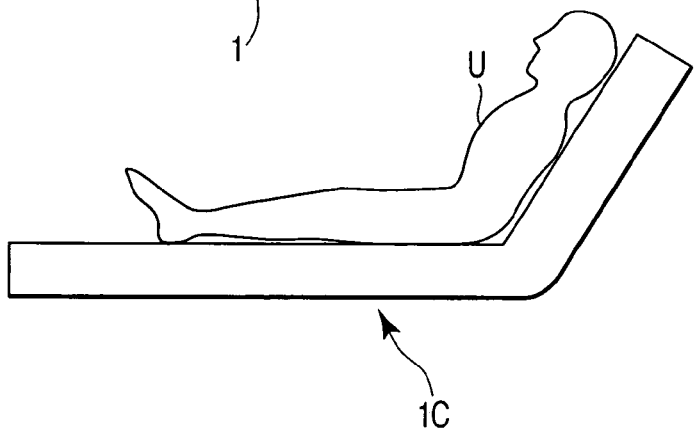

Therefore, as shown in FIG. 14C, in the mattress apparatus 1C using the spring unit 5B configured as above, the user U can not only hold the head but also sit up by bending upward the two portions 12*x* and 12*y* of the movable rod member.

The spring unit 5C shown in FIG. 13C combines the structures of FIG. 13A and FIG. 13B. Namely, both end portions of the spring unit 5C can be bent up and down reversely by the movable rod member 12. One movable rod member 12 is composed of two portions 12*x* and 12*y*. The two portions 12*x* and 12*y* can be bent in the same direction by the hinge mechanism 13. The frame wire 8 is divided at the part corresponding to the respective hinge mechanism 13.

Therefore, the spring unit 5C configured as above can be bent as indicated by the chain line in the same drawing, and the user can sit up and bend his/her legs.

In other words, actions made by raising the floor plate by a back-rising mechanism in the past can be realized by the spring unit 5C constituting a mattress apparatus.

Figure 15:
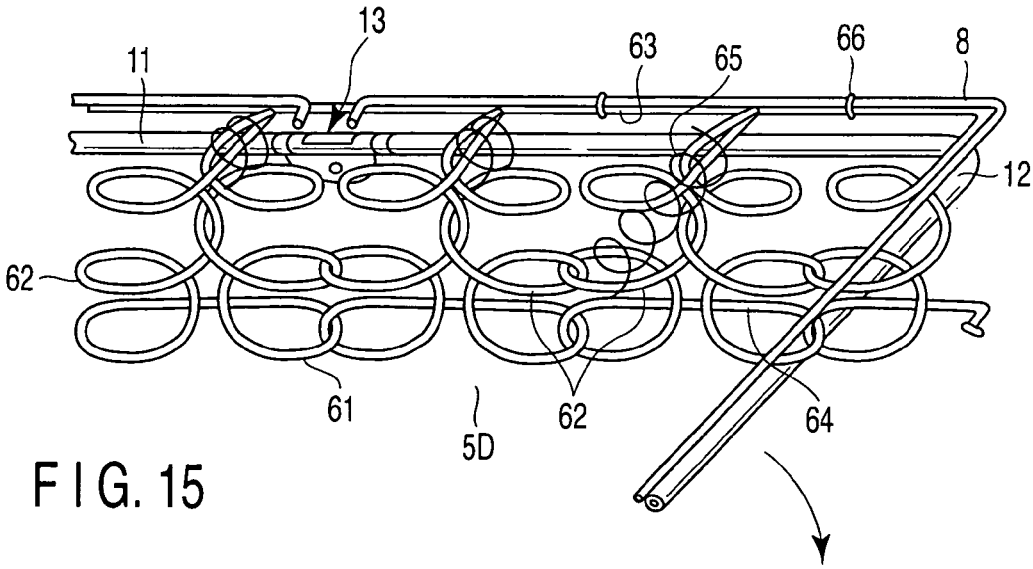
FIG. 15 is a perspective view showing a part of a spring unit according to a sixth embodiment of the present invention.

FIG. 15 shows a sixth embodiment of the invention. This embodiment is a modification of a spring body constituting a spring unit. Namely, a continuous spring 61 is used instead of a coil spring in a spring body constituting a spring unit 5D. The continuous spring 61 has several coil portions 62. The axial lines of the coil portions 62 are substantially paralleled by one wire. In a pair of adjacent coil portions 62, the windings at the middle portion are engaged, the upper ends are continued by an upper connection rod 63, and the lower ends are continued by a lower connection rod 64.

The continuous springs 61 provided side by side are connected by a helical wire 65 provided along the direction crossing the direction provided with the continuous springs. In the peripheral edge portion of the upper and lower surfaces of the spring unit 5D, the frame wire 8 is fixed with a clip 66 as in the first embodiment. Though not shown in detail, the frame wire 8 is divided at the part corresponding to the joint of the fixed rod member 11 and movable rod member 12 connected by the hinge mechanism 13.

FIG. 15 shows the spring unit 5D viewed from the lower side. The end portion provided with the movable rod member 12 is bent by the hinge mechanism 13 in the direction indicated by the arrow in the drawing.

The fixed rod member 11 and movable rod member 12 are inserted between the windings of the coil portion 62 placed in the periphery of the spring unit 5D, and held by a holding means as in the first embodiment.

Therefore, even if the spring unit 5D is composed of the continuous spring 61 or a spring body other than a coil spring, one end portion of the spring unit 5D can be bent in the rising direction by the movable rod member 12.

Figure 16:
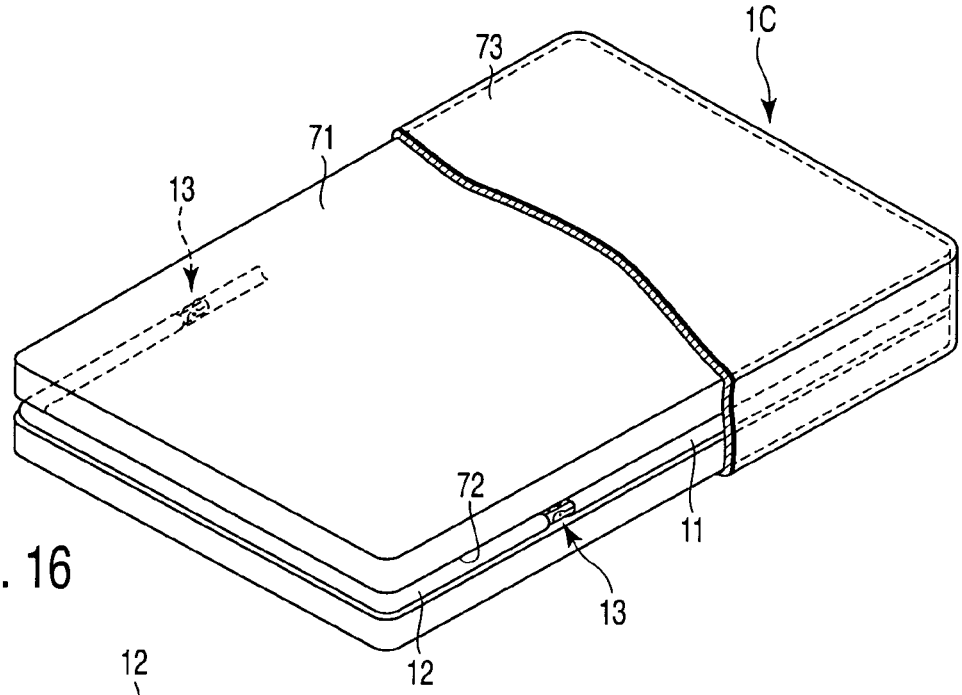
FIG. 16 is a partially broken away perspective view of a mattress apparatus according to a seventh embodiment of the present invention.
Figure 17:
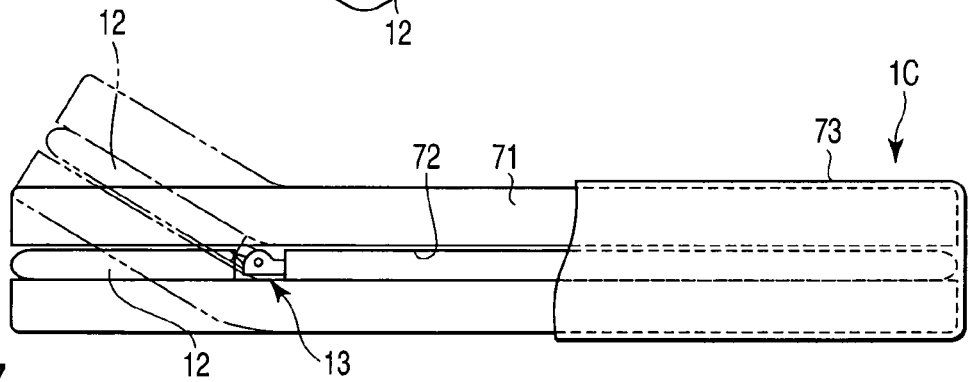
FIG. 17 is a side view of the mattress apparatus shown in FIG. 16.

FIG. 16 and FIG. 17 show a seventh embodiment of the invention. The mattress apparatus 1C of this embodiment has a cushion body made of soft or semi-hard foamed elastic body 71, instead of the spring unit used in the aforementioned embodiments. The foamed elastic body 71 is a square plate, and has a holding groove 72 constituting a holding means in the full length of the periphery.

In the holding groove 72, the fixed rod member 11 and movable rod member 12 made by bending a pipe U-shaped are elastically pressed into and held. Both end portions of the fixed rod member 11 and movable rod member 12 are connected by the hinge mechanism 13 movably and held at a specified angle. The foamed elastic body 71 is covered with an exterior cloth 73.

In the mattress apparatus 1C configured as above, when the movable rod member 12 is bent by the hinge mechanism 13 at a specified angle against the fixed rod member 11, the part of the foamed elastic body 71 corresponding to the movable rod member 12 is elastically bent by the fitting of the movable rod member 12 in the holding groove 72. Therefore, one end portion of the mattress apparatus 1C can be bent as indicated by the chain line in FIG. 17.

Namely, the present invention can also be applied to a cushion body made of foamed elastic body as well as a spring unit.

In the aforementioned embodiments, when the cushion body is a spring unit, the fixed rod member and movable rod member may be covered with a sheet made of resin, such as urethane foam, or sprayed with foamed resin. This structure can prevent the noise produced when the rod member bumps against the spring body of the spring unit.

Figure 18:
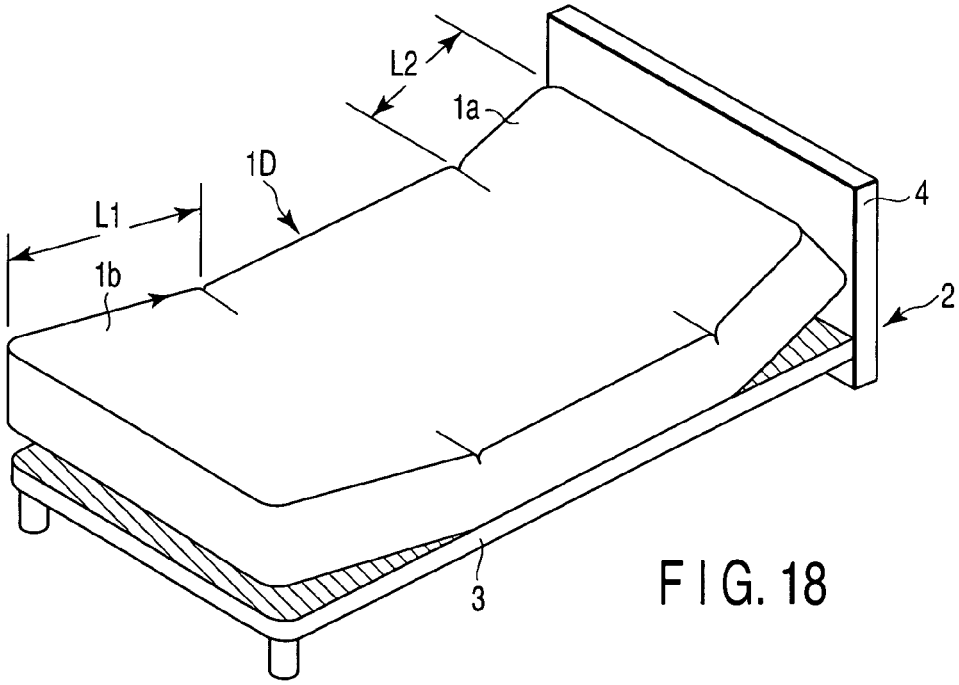
FIG. 18 is a perspective view of a bed apparatus according to an eighth embodiment of the present invention.
Figure 19A:
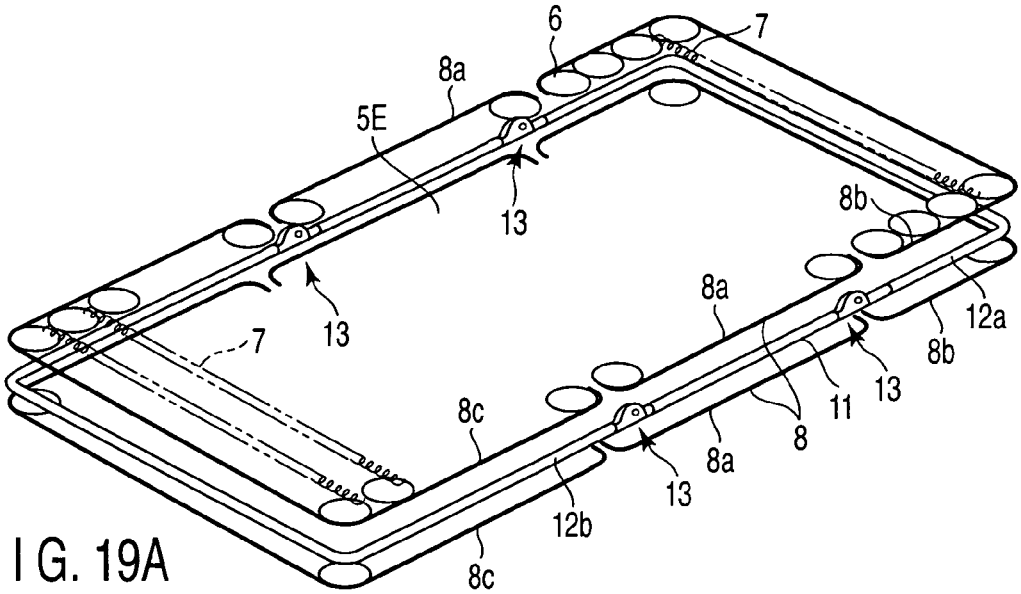
FIG. 19A is a perspective view of a spring unit.
Figure 19B:
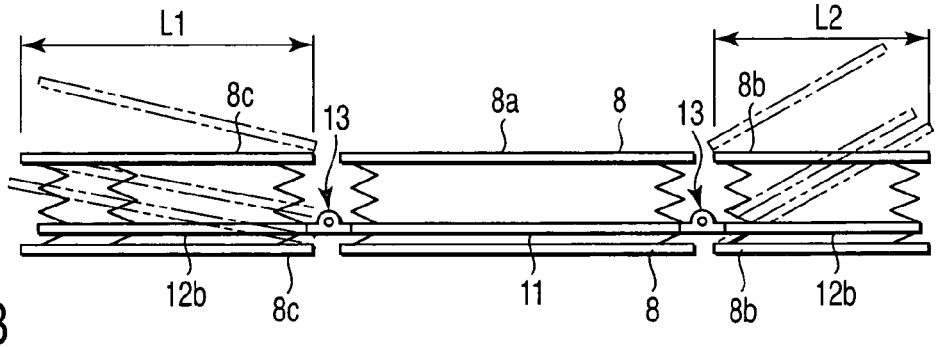
FIG. 19B is a side view of the spring unit shown in FIG. 19A.

FIG. 18, FIG. 19A and FIG. 19B show an eighth embodiment of the invention. In the mattress 1D of this embodiment, as shown in FIG. 18, not only one end portion 1*a* of the longitudinal direction placed to the user's head side but also the other end portion 1*b* placed to the foot side can be bent in the rising direction.

FIGS. 19A and 19B show a spring unit 5E used in the mattress 1D. The frame wire 8 provided in the peripheral edge portion of the upper and lower surfaces of the spring unit 5E is divided into a first straight portion 8*a* provided along the central part of the longitudinal direction on both sides of the lateral direction of the spring unit 5E, a second U-shaped portion 8*b* provided at one end portion of the longitudinal direction, and a third U-shaped portion 8*c* provided at the other end portion.

In the periphery of the spring unit 5E, a fixed straight rod member 11 is provided at the middle part of the longitudinal direction on both sides of the lateral direction. A first U-shaped movable rod member 12*a* is provided at one end portion of the longitudinal direction of the spring unit 5E, and a second U-shaped movable rod member 12*b* is provided at the other end portion.

Both ends of the first movable rod member 12*a* are connected to one end of the pair of fixed rod members 11 by the hinge mechanism 13 movably in the rising direction. Both ends of the second movable rod member 12*b* are connected to the other end of the pair of fixed rod members 11 by the hinge mechanism 13 movably in the rising direction, like the first movable rod member 12*a*.

As shown in FIG. 19B, assuming that the length dimension of the first movable rod member 12*a* along the longitudinal direction of the spring unit 5E is L1 and the length dimension of the second movable rod member 12*b* along the longitudinal direction of the spring unit 5E is L2, L1 is set to larger than L2.

Though not shown in detail, like the first embodiment, the upper/lower surfaces and periphery of the spring unit 5E are covered with the exterior cloth 37. The fixed rod member 11 and first and second movable rod members 12*a* and 12*b* are held in the periphery of the spring unit 5E by the peripheral portion of the holding cloth 33 provided on the lower surface of the spring unit 5E.

As shown in FIG. 18, the mattress 1D configured as above is provided with one end portion 1*a* having the second movable rod member 12*b* placed to the headboard 4 side of the bed 2.

The user lies on his (her) back on the mattress 1D with the head placed to the headboard 4 side. The user can take the position with the head raised by using one end portion 1*a* of the mattress 1D, and the position with the legs raised by using the other end portion 1*b*. The user can also take the position with both head and legs raised.

The mattress 5D permits to raise the other end portion 1*b* of the first movable rod member 12*a* placed to the user's feet side in the length longer than one end portion 1*a* of the second movable rod member 12*b* placed at the user's head side.

Therefore, the user can stably raise and hold the legs longer than the head by using the other end portion 1*b* having the first movable rod member 12*a* of the mattress 5D. Namely, the user can easily keep the position with the legs raised.

According to the first to eighth embodiments of the present invention, when the movable rod member is raised at a specified angle, at least the part of the cushion body where the user's head is placed can be bent with the movable rod member, and the user can raise and hold the head.

Namely, at least one end portion of the mattress apparatus can be raised without using a conventional bed floor plate raising mechanism, and the cost can be reduced.

Figure 20:
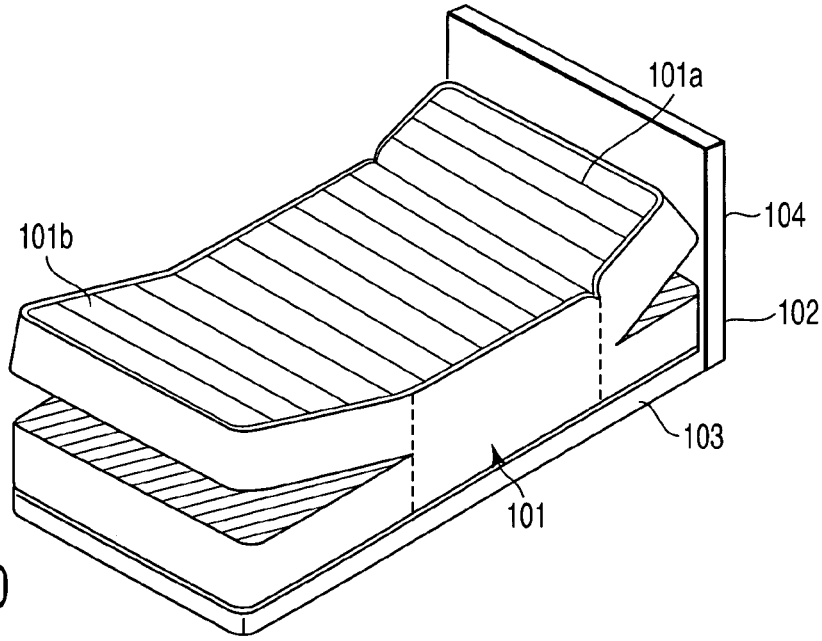
FIG. 20 is a perspective view of a bed using a mattress apparatus according to a ninth embodiment of the present invention.

FIG. 20 to FIG. 28 show a ninth embodiment of the invention. FIG. 20 is a perspective view showing the state that a mattress apparatus 101 is placed on a base 103 of a bed 102. The mattress apparatus 101 is configured to raise and hold one end portion 101*a* of the longitudinal direction placed to the headboard 104 side of the bed 102 and the other end portion 101*b* at a specified angle as described later.

The mattress apparatus 101 is constructed by laying an upper spring unit 109 as an upper cushion body on a bottom spring unit 108 as a bottom cushion body having a square plane.

Figure 23A:
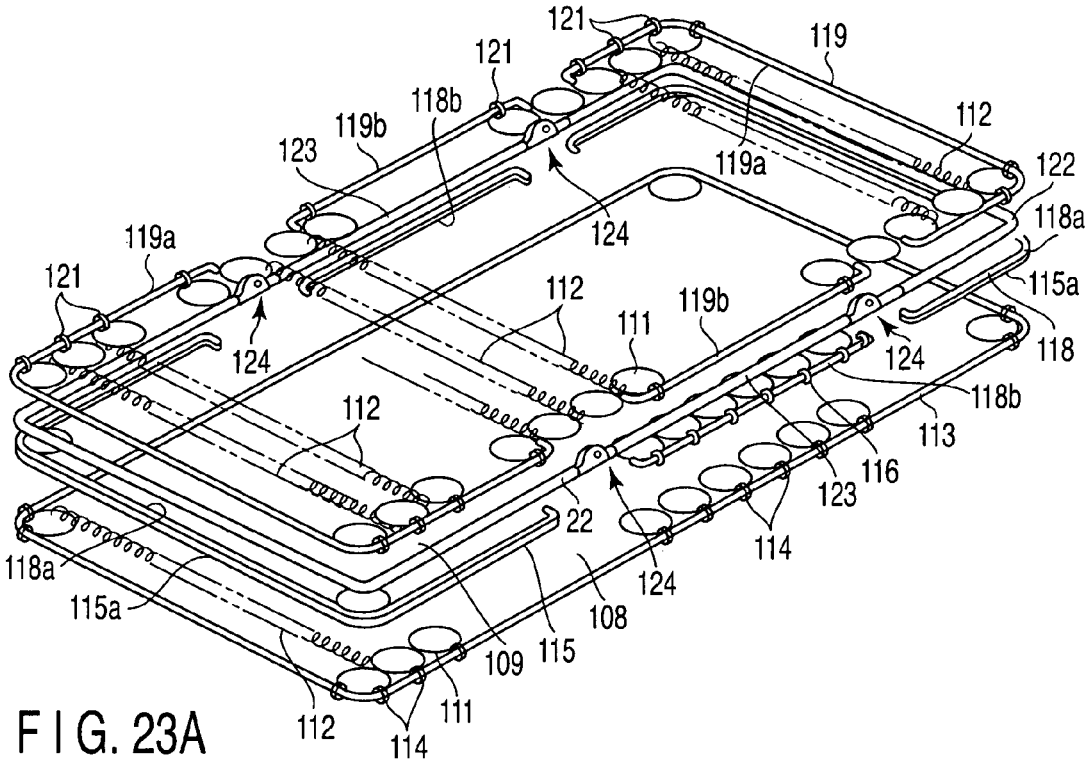
FIG. 23A is a perspective view showing the simplified configuration of a spring unit.
Figure 23B:
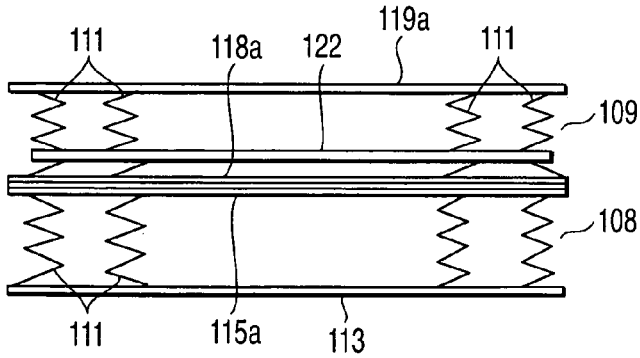
FIG. 23B is a side view of a spring unit.
Figure 23C:
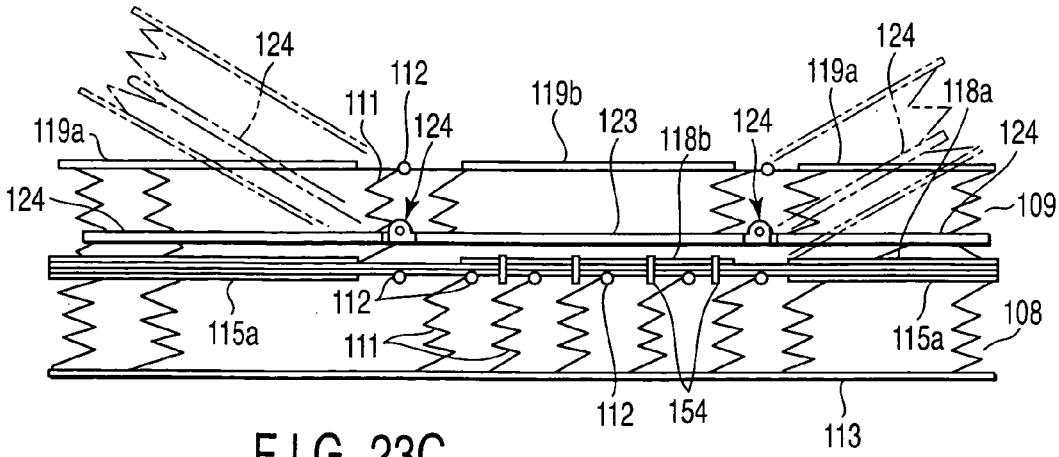
FIG. 23C is a front view of a spring unit.

The spring units 108 and 109 have rows of coil springs 111 as shown in FIGS. 23A to 23C. The upper end face and lower end face of the coil spring 111 adjacent along the longitudinal direction of the spring units 108 and 109 are connected by a helical wire 112.

A lower frame wire 113 made of a square frame-shaped wire is fixed to the peripheral edge portion of the lower surface of the bottom spring unit 108 with a clip 114. An upper frame wire 115 is provided at the peripheral edge portion of the upper surface of the bottom spring unit 108. The upper frame wire 115 is divided into a pair of U-shaped portions 115*a* provided at both ends of the bottom spring unit 108. These U-shaped portions 115*a* are connected by a clip 116 to the upper end face of the coil spring 111 located at both ends of the longitudinal direction of the bottom spring unit 108.

A lower frame wire 118 is provided at the peripheral edge portion of the lower surface of the upper spring unit 109, and an upper frame wire 119 is provided at the peripheral edge portion of the upper surface. As shown in FIG. 23, the lower frame wire 118 is divided into a pair of U-shaped portions 118*a* provided at both ends of the longitudinal direction of the spring unit 109 and a pair of straight rod portions 118*b* provided on both sides of the lateral direction. The U-shaped portion 118*a* and straight rod portion 118*b* are connected and fixed with a not-shown clip to the lower end face of the coil spring 111 located at the peripheral edge portion of the upper spring unit 109.

The upper frame wire 119 is divided into a pair of U-shaped portions 119*a* connected and fixed with a clip 121 to both ends of the longitudinal direction of the upper spring unit 109, and a pair of straight rod portions 119*b* fixed with the clip 121 to both sides of the lateral direction of the upper spring unit 109.

By dividing the lower frame line 118 and upper frame line 119 provided at the peripheral edge portions of the upper and lower surfaces of the upper spring unit 109 into three portions, one end portion and the other end portions of the longitudinal direction of the upper spring unit 109 can be bent upward.

In the periphery of the upper spring unit 109, a pair of movable rod members 122 and a pair of fixed straight rod members 123 are provided integrally with the upper spring unit 109 by a holding means to be described later. The movable rod members 122 are made by bending a pipe U-shaped at both ends of the longitudinal direction corresponding to the pair of U-shaped portions 119*a* of the upper frame wire 119. The fixed straight rod members 123 are made also of a pipe at the middle part of the both sides of the lateral direction corresponding to the straight rod member 119*b*.

The length of the upper spring unit 109 along the longitudinal direction of the movable rod member 122 provided at one end portion of the longitudinal direction is set shorter than the length along the longitudinal direction of the movable rod member 122 provided at the other end portion.

Both ends of the pair of movable rod members 122 are connected to both ends of the fixed rod member 123 with a hinge mechanism 124 movably and held at a specified angle.

Figure 22:
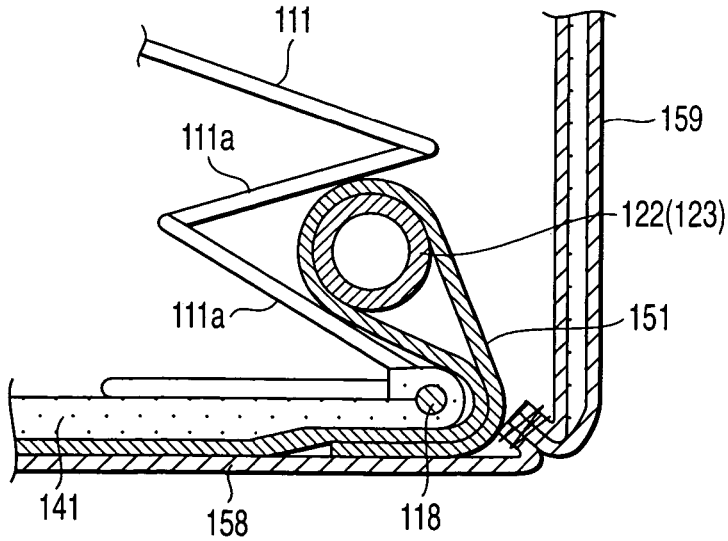
FIG. 22 is a magnified sectional view showing a means of holding a fixed rod member or a movable rod member in an upper spring unit.
Figure 26:
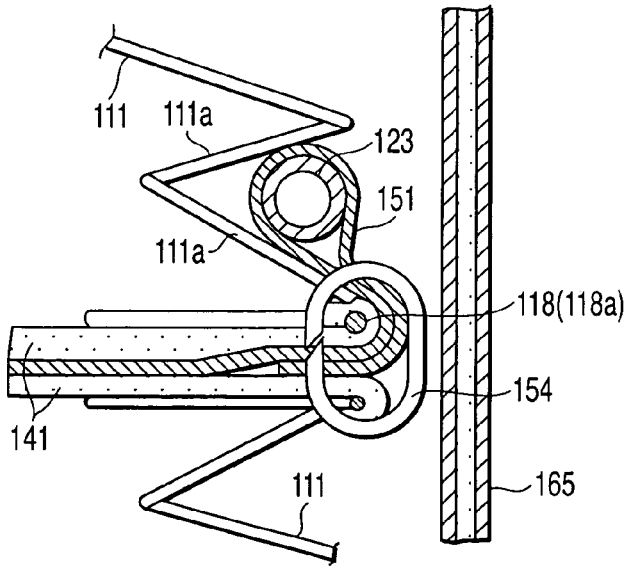
FIG. 26 is a sectional view showing one end portion in the lateral direction connected by the clips of a bottom spring unit and an upper spring unit.

The movable rod member 122 and fixed rod member 123 connected by the hinge mechanism 124 are formed as a square frame a little smaller than the shape of the plane of the upper spring unit 109. Thus, the movable rod member 112 and fixed rod member 123 provided in the periphery of the upper spring unit 109 are inserted into the middle part of the axial direction of the spring of the coil spring 111 placed in the periphery of the upper spring unit 109, that is, between the spiral windings 111*a* of the lower end portion in this embodiment, and held together with the upper spring unit 106, as shown in FIG. 22 and FIG. 26.

Figure 25:
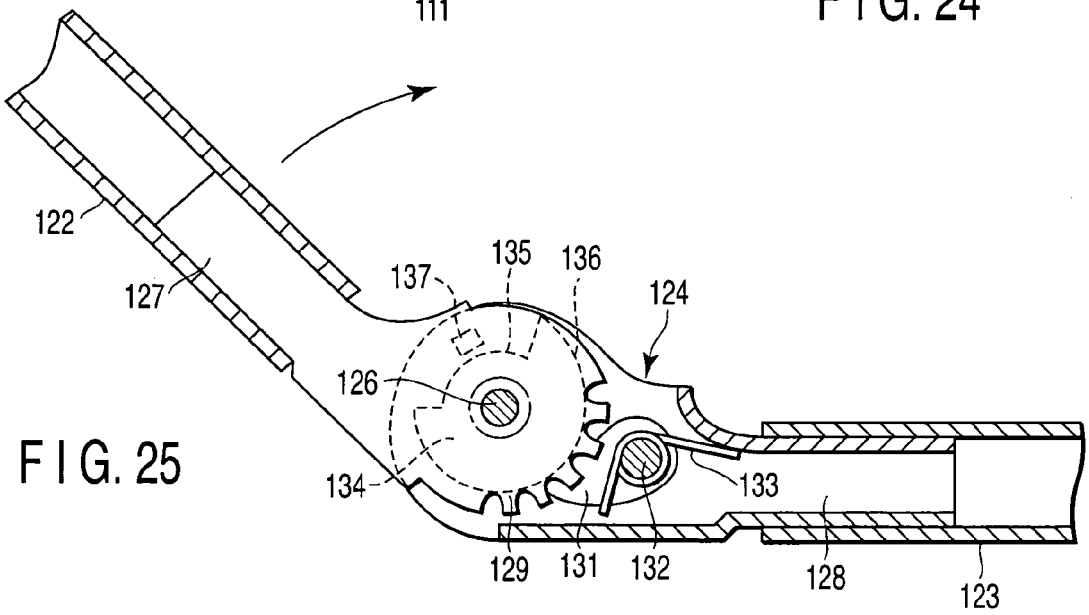
FIG. 25 is a partially broken away side view of a hinge mechanism.

The hinge mechanism 124 has a first arm 127 and a second arm 128 as fitting members, with one end attached to a pivot 126 as shown in FIG. 25. The other end portion of the first arm 127 is fit into and fixed to the end portion of the movable rod member 122. The other end of the second arm 128 is fit into and fixed to the end portion of the fixed rod member 123.

Teeth 129 are formed at one end of the first arm 127. A stopper 131 to engage with the teeth 129 is pivotally attached to one end of the second arm 128 by a pin 132. The stopper 132 is energized in the direction to engage with the teeth 129 by a spring 133.

A cam plate 134 is rotatably attached to the pivot 126. A concave 135 and a convex 136 are formed at a specified angle in the direction of the circumference of the periphery of the cam plate 134. The radius of the convex 136 from the pivot 126 is made larger than the radius of the teeth 129 from the pivot 126. At one end of the first arm 127, an engagement body 137 placed in the concave 135 is provided in the state that the stopper 131 engages with the teeth 129.

Thus, the first arm 127 can be held at a specified rotation angle against the second arm 128 by the engagement of the stopper 131 and teeth 129. The stopper 131 rides on the convex 136 of the cam plate 134 and disengages from the teeth 129, by moving the first arm 127 in the direction indicated by the arrow in FIG. 25 and interlocking the cam plate 134 with this movement by the engagement body 137 contacting one end of the concave 25. Then, the first arm 137 can be freely moved in the direction reverse to the arrow.

The first arm 127 can be moved in the direction reverse to the arrow, until the engagement body 137 contacts the other end of the concave 135 and rotates the cam plate 134, and the stopper 131 disengages from the convex 136 of the cam plate 134 and engages with the teeth 139, that is, until the first arm 127 becomes substantially horizontal against the second arm 128.

Therefore, the movable rod member 122 can be raised and held by the hinge mechanism 124 at a specified angle against the fixed rod member 123, and can also be laid flat.

Figure 21:
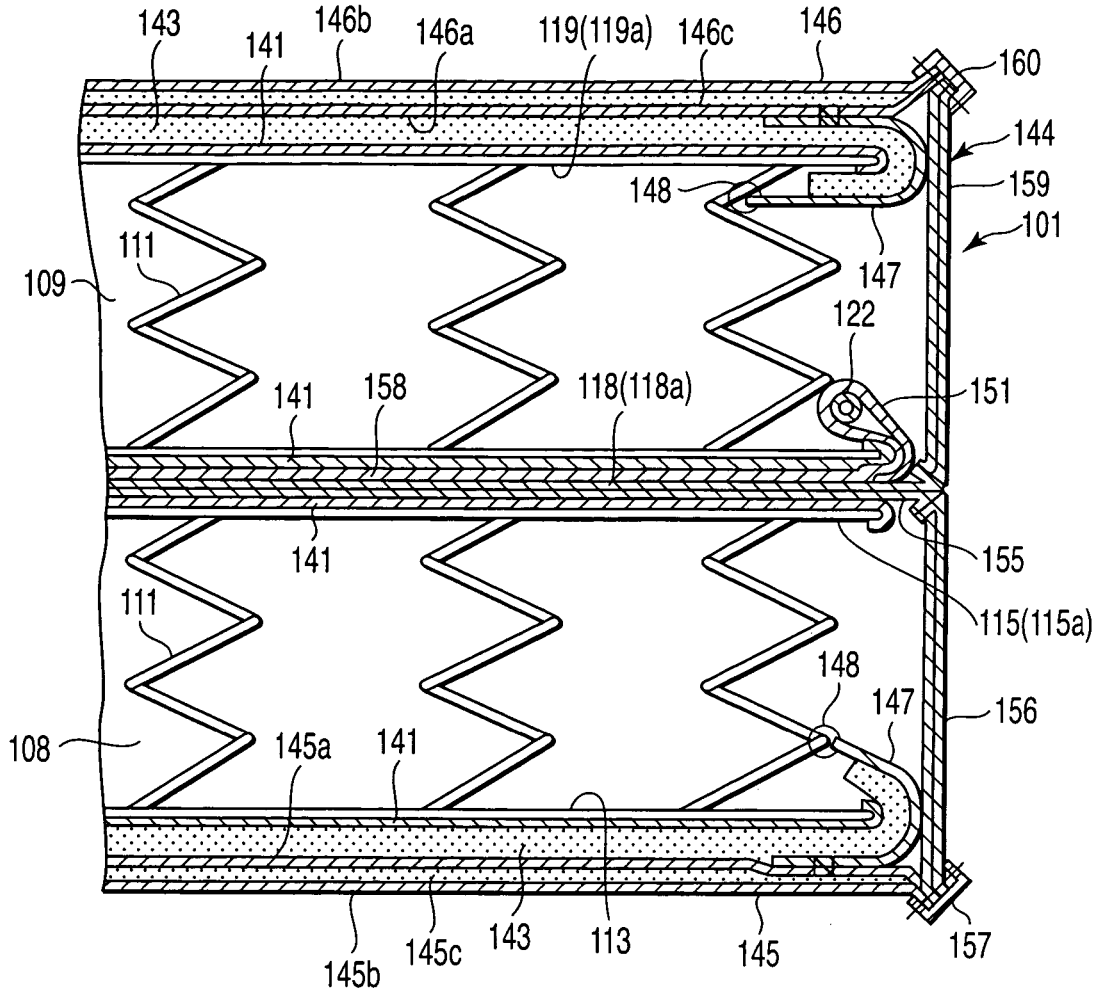
FIG. 21 is a magnified sectional view showing a part of a mattress apparatus.

As shown in FIG. 21, on the upper and lower surfaces of the bottom spring unit 108 and upper spring unit 109, felt 141 larger than the shape of the plane of the spring units 108 and 109 is laid. The periphery of the felt 141 is fixed with a clip 142 (partially shown in FIG. 24), involving the frame wires 113, 115, 118 and 119 provided at the peripheral edge portion of the upper and lower surfaces of the spring unit 108 and 109.

An elastic sheet 143 such as urethane foam is laid on the lower surface of the bottom spring unit 108 and the upper surface of the upper spring unit 109. The elastic sheet 143 is covered with a lower face cloth 145 and upper face cloth 146 constituting an exterior cloth 144. The face cloths 145 and 146 have a three-layer structure, in which elastic sheets 145*c* and 146*c* are put between back cloths 145*a*/146*a* and front cloths 145*b*/146*b*, and quilted therewith. The quilting of the face cloths 145 and 146 is formed along the lateral direction as shown in FIG. 20.

As shown in FIG. 21, a flange cloth 147 is provided in the periphery of the back cloths 145*a* and 146*a* with one end portion of the lateral direction stitched. The other end portion of the flange cloth 147 is connected and fixed to the coil spring 111 placed in the peripheries of the spring units 108 and 109 with a clip 148, involving the periphery of the elastic sheet 143.

On the felt 141 provided on the lower surface of the upper spring unit 109, a holding cloth 151 that constitutes a holding means and shaped square larger than the shape of the plane of the spring unit 109 is laid.

The periphery of the holding cloth 151 extended outward from the periphery of the upper spring unit 109 is wound from the internal to external circumference around the movable rod member 122 and fixed rod member 123, as shown in FIG. 21, FIG. 22, FIG. 24 and FIG. 26, and returned to the periphery of the lower surface of the upper spring unit 109.

Figure 24:
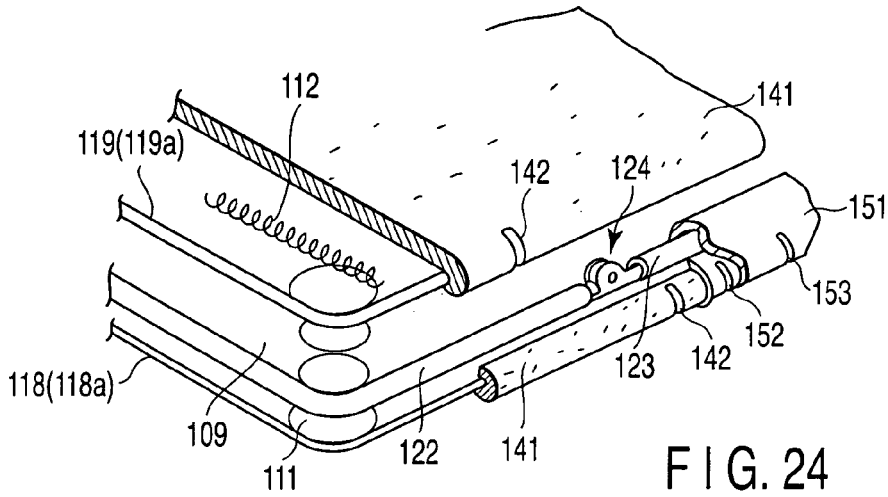
FIG. 24 is a partially broken away perspective view showing the structure of holding a fixed rod member and a movable rod member in an upper spring unit.

As shown in FIG. 24, the part of the holding cloth 151 toward the internal circumferences of the rod members 122 and 123 is connected and fixed by a clip 152 to the frame wire 118 of the lower side together with the end portion of the felt 141. The part bent from the internal to external circumference is connected and fixed by a clip 153 to the frame wire 118 together with the part toward the internal circumference. Thus, the movable rod member 122 and fixed rod member 123 are fastened together to the spring unit 109 by the periphery of the holding cloth 151.

As shown in FIG. 26 and FIG. 23C, at the middle part of the longitudinal direction of both sides of the laid bottom spring unit 108 and upper spring unit 109, the upper end face of the coil spring 111 of the bottom spring unit 108 and the straight rod portion 118*b* of the lower frame wire 118 of the upper spring unit 109 are connected to the pair of felt 141 and holding cloth 151 with a clip 154. Thus, the middle part, in the longitudinal direction, of both sides of the upper spring unit 109 is connected to the bottom spring unit 108.

As the movable rod member 122 and fixed rod member 123 are fastened together to the upper spring unit 109, when the movable rod member 122 is turned at a specified angle against the fixed rod member 123, one end portion and the other end portion of the upper spring unit 109 corresponding to the movable rod member 122 can be bent and raised at a specified angle as indicated by the chain line in FIG. 23C.

The movable rod member 122 provided at one end portion in the longitudinal direction of the upper spring unit 109 is shorter than the movable rod member 122 provided at the other end portion, and the length of the part bent upward of one end portion 101*a* and the other end portion 101*b* of the upper spring unit 109 is also different according to the length difference between these movable rod members 122.

Further, as the peripheral edge of the holding cloth 151 is wound around the rod members 122 and 123, a "clunk" sound is prevented when the rod members 122 and 123 bump against the coil spring 111.

The movable rod member 122 is shaped substantially U surrounding three sides of the upper spring unit 109. Thus, the upper spring unit 109 is prevented from twisting in the lateral direction by the movable rod member 122. Especially, when the movable rod member 122 is raised and one end portion and the other end portion of the upper spring unit 109 are bent upward, the bent portions of the upper spring unit 109 become easy to twist in the lateral direction, but the twist in the lateral direction can be prevented by the U-shaped movable rod member 122.

The movable rod member 122 and fixed rod member 123 are engaged between windings 111*a* of the coil spring 111 placed in the periphery of the upper spring unit 109. Thus, these rod members 122 and 123 are engaged and fastened together to the upper spring unit 109 without using the holding cloth 151, and one end portion and the other end portion of the upper spring unit 109 corresponding to the movable rod member 122 can be bent interlocking with the rotation of the movable rod member 122.

The exterior cloth 144 has, in addition to the face cloths 145 and 146, a pair of auxiliary face cloths 155 covering the upper surface of the both end portions of the longitudinal direction of the bottom spring unit 108, and a lower side cloth 156 covering the peripheries of the three sides of the both end portions of the longitudinal direction of the bottom spring unit 108, as shown in FIGS. 27A–27C and FIG. 21. The upper end of the lower side cloth 156 is stitched to three sides of the peripheral edge portion of the auxiliary face cloth 155, and the lower end is fastened to the peripheral edge of the lower face cloth 145 with a lower tape edge 157.

The exterior cloth 144 has a pair of auxiliary lower face cloths 158 covering the lower surface of both end portion of the longitudinal direction of the upper spring unit 109, and an upper side cloth 159 covering the peripheries of three sides of the both end portions of the longitudinal direction of the upper spring unit 109. The lower end of the upper side cloth 159 is stitched to the three sides of the auxiliary lower face cloths 158, and the upper end is fastened to the peripheral edge of the upper face cloth 146 with an upper tape edge 160.

Figure 27A:
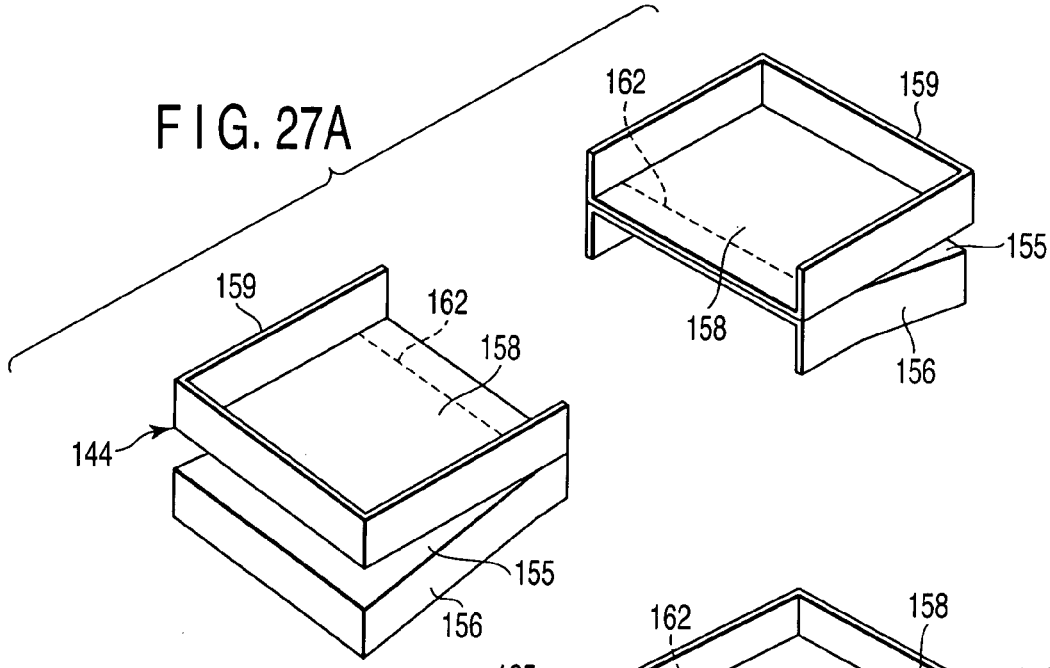
FIGS. 27A and 27B are perspective views showing a part of an exterior cloth.

As shown in FIG. 27A, the not-stitched ends of the side cloths 156 and 159 of the layered auxiliary upper face cloth 155 and auxiliary lower face cloth 158 are stitched at a first sewing line 162.

Figure 27B:
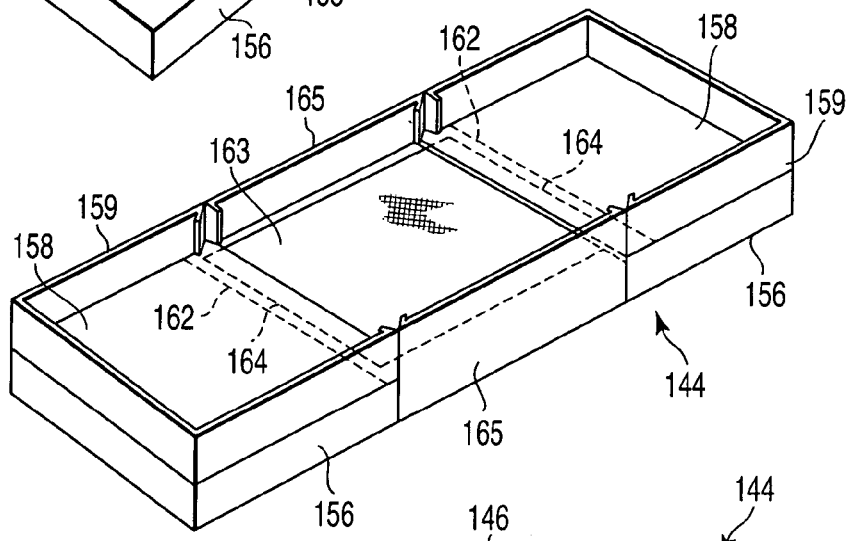

To one end of the pair of auxiliary upper face cloth 155 and auxiliary lower face cloth 158 stitched at the first sewing line 162, one end portion and the other end portion of a connection cloth 163 are connected at a sewing line 164 as shown in FIG. 27B. Namely, the pair of auxiliary upper face cloth 155 and auxiliary lower face cloth 158 is connected by the connection cloth 163.

As shown in FIG. 27B, the middle part of the direction of the height of an intermediate side cloth 165 is stitched to both ends of the lateral direction of the connection cloth 63. One end and the other end of the longitudinal direction of the pair of intermediate side cloths 165 are stitched to the ends of the lower side cloth 156 and upper side cloth 156.

Figure 27C:
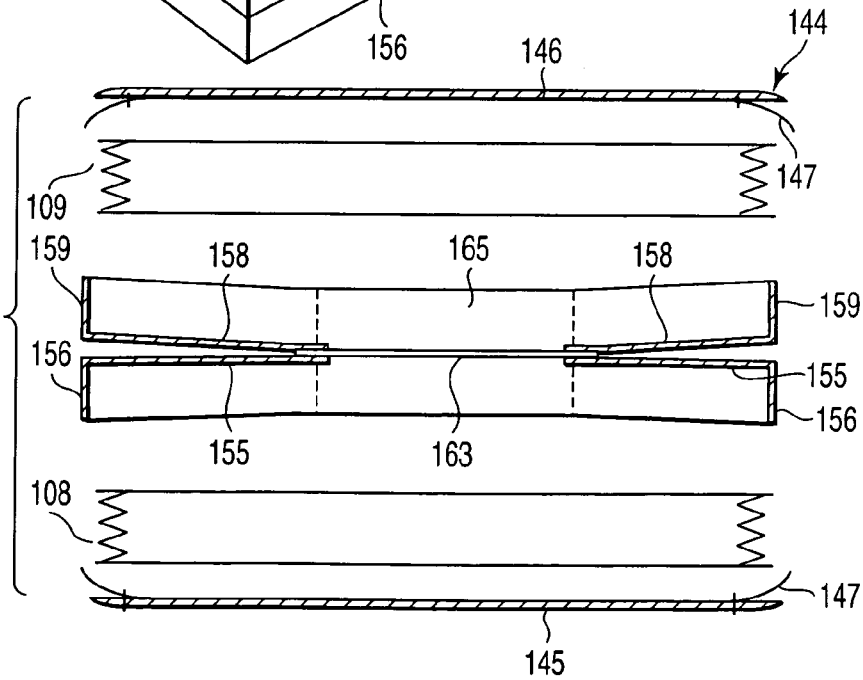
FIG. 27C is an exploded view showing an exterior cloth and two spring units.

As shown in FIG. 27C, the bottom spring unit 108 is housed in the space between the pair of auxiliary upper face cloth 155 and lower side cloth 156, and the lower surface is covered with the lower face cloth 145. The peripheral edge portion of the lower face cloth 145 and the lower ends of the lower side cloth 156 and intermediate side cloth 165 are stitched with the lower tape edge 157.

The upper spring unit 109 is housed in the space between the pair of auxiliary lower face cloth 158 and upper side cloth 159. The upper surface of the upper spring unit 109 is covered with the upper face cloth 146. The peripheral edge portion of the upper face cloth 146 and the upper ends of the upper side cloth 159 and intermediate side cloth 165 are stitched with the upper tape edge 160.

As described above, the bottom spring unit 108 and upper spring unit 109 are covered together with the exterior cloth 144. One end portion and the other end portion of the upper spring unit 109, that is, the both end portions bent upward together with the movable rod member 122, are covered separately from the bottom spring 108 with the auxiliary lower face cloth 158 and auxiliary upper face cloth 155.

Thus, even if one end portion and the other end portion of the spring unit 109 are bent upward, the upper surface of the bottom spring unit 108 and the lower surface of the upper spring unit 109 are not exposed.

On the upper and lower surfaces of the bottom spring unit 108 and upper spring unit 109 housed in the space of the exterior cloth 144, the felt 141, elastic sheet 143 and holding cloth 151 are previously layered on and fixed to the spring units 108 and 109.

In the mattress apparatus 101, a pair of movable rod member 122 and fixed rod member 123 is provided in the periphery of the spring unit 109 by engaging between the windings 111*a* of the coil spring 111, and these rod members 122 and 123 are fastened together to the spring unit 109 by the holding cloth 151. The movable rod member 122 and fixed rod member 123 are connected by the hinge mechanism 124 movably and held at a specified angle.

Thus, when a pair of movable rod members 122 is moved in the rising direction relative to the fixed rod member 123 from the state indicated by the solid line in FIG. 23C and held at a specified angle as indicated by the chain line, both end portions of the spring unit 109 corresponding to the movable rod member 122 can be bent interlocking with the movement of the movable rod member 122 as indicated by the chain line.

When one end portion of the spring unit 109 is bent by the movable rod member 122, one end portion 101*a* and the other end portion 101*b* of the mattress apparatus 101 can be raised and held at a specified angle as shown in FIG. 20.

Figure 28:
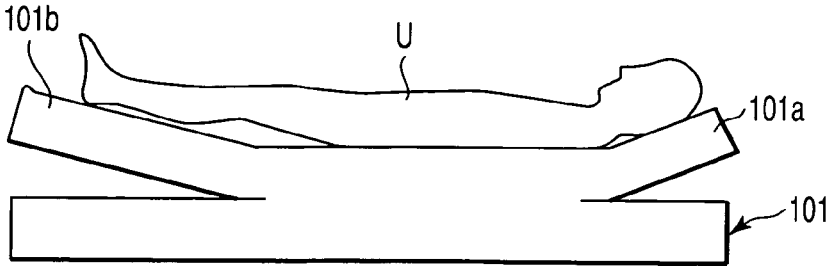
FIG. 28 is an explanatory drawing showing a user lying on his (her) back on a mattress apparatus.

As shown in FIG. 28, the user U lying on his (her) back on the upper surface of the mattress apparatus 101 can easily hold the position with the head raised a little, and the user can read a book or watch TV in the position lying on his (her) back. Further, the user can improve their blood circulation in the legs, and recover soon from the fatigue.

The pair of movable rod members 122 is different in the length dimension along the longitudinal direction of the upper spring unit 109. Thus, the length dimension of the mattress apparatus 101 to be bent upward can be set longer in one end portion 101*a* than the other end portion 101*b*, as shown in FIG. 20. Namely, the other end portion 101*b* to support the legs of the user U is made long to meet the length of the legs, and one end portion 101*a* to support the head is set to meet the length to support the head.

Therefore, the user U can be supported in the state that the head and legs are stably held.

As described above, one end portion 101*a* and the other end portion 101*b* of the mattress apparatus 101 can be raised and held at a specified angle by a pair of movable rod members 12. Therefore, the structure for raising one end portion and the other portion of the mattress apparatus 101 can be made simple at a low price compared with the conventional method of raising a floor plate by a driving mechanism for raising the floor plate.

The bottom spring unit 108 and upper spring unit 109 are covered together with the exterior cloth 144. The movable rod member 122, fixed rod member 123 and hinge mechanism 124 provided in the periphery for bending one end portion and the other end portion of the upper spring unit 109 are not seen from the outside. The rod members 122 and 123 are inserted between the windings 111*a* of the coil spring 111 placed in the periphery of the upper spring unit 109, and not projected outward from the periphery of the mattress apparatus 101.

Though both end portions can be bent upward, the appearance of the mattress apparatus 101 is the same as an ordinary mattress apparatus, and has a very good appearance.

Both end portions of the longitudinal direction of the upper spring unit 109 that can be bent upward, and both end portions of the longitudinal direction of the bottom spring unit 108 are configured to be separately covered with the exterior cloth 144. Namely, at both end portions of the upper spring unit 109, the upper surface is covered with the upper face cloth 146, the lower surface is covered with the auxiliary lower face cloth 158, and the periphery is covered with the upper side cloth 159.

In the portions of the bottom spring unit 108 corresponding to both end portions of the upper spring unit 109, the lower surface is covered with the lower face cloth 145, the upper surface is covered with the auxiliary upper face cloth 155, and the periphery is covered with the lower side cloth 156.

Thus, one end portion and the other end portion of the upper spring unit 109 can be bent upward. Further, when the portions are bent upward, the upper surface of the bottom spring unit 108 is not exposed to the outside, and the lower surface of the upper spring unit 109 is not exposed to the outside. This provides a very good appearance.

Figure 29:
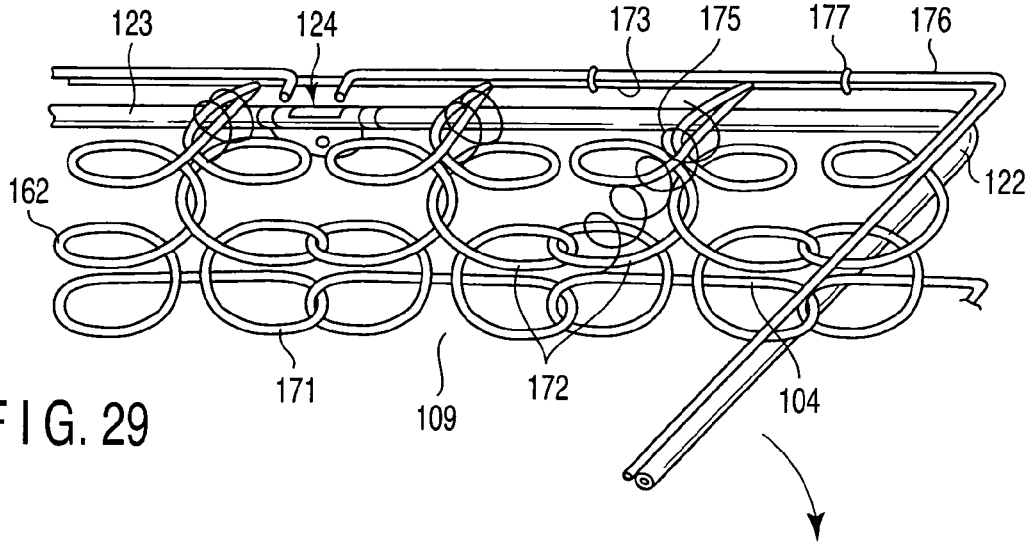
FIG. 29 is a perspective view of a part of an upper spring unit according to a tenth embodiment of the present invention.

FIG. 29 shows a modification of a spring body constituting an upper spring unit 109 according to a tenth embodiment of the invention. FIG. 29 is a perspective view of the upper spring unit 109 viewed from the lower surface side.

A continuous spring 171 is used instead of a coil spring in a spring body constituting a spring unit 109. The continuous spring 171 has several coil portions 172. The axial lines of the coil portions 172 are substantially paralleled by one wire. In a pair of adjacent coil portions 172, the windings at the middle portion are engaged, the upper ends are continued by an upper connection rod 173, and the lower ends are continued by a lower connection rod 174.

The continuous springs 171 provided side by side are connected by a helical wire 175 provided along the direction crossing the direction provided with the continuous springs. In the peripheral edge portion of the upper and lower surfaces of the spring units 108 and 109, the frame wire 176 is fixed with a clip 177. Though not shown in detail, the frame wire 176 is divided at the part corresponding to the joint of the movable rod member 122 and fixed rod member 123 connected by the hinge mechanism 124. The movable rod member 122 can be moved in the direction indicted by the arrow in the same drawing.

As described above, a spring body to constitute the spring units 108 and 109 is not limited to a coil spring. A continuous spring body as described above may be used.

When an upper spring unit is formed by a continuous spring, the configuration of a bottom spring unit is not limited. For example, either a coil spring or a continuous spring may be used.

Figure 30:
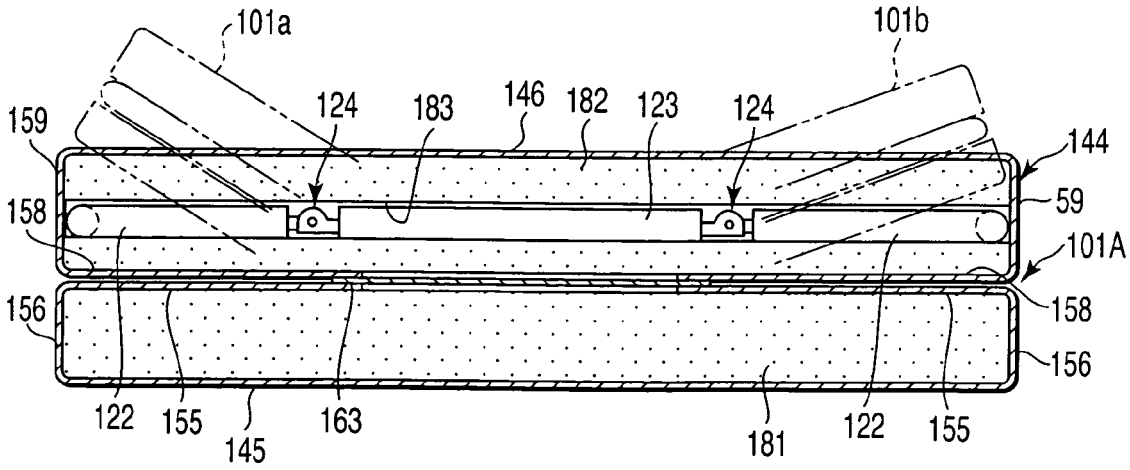
FIG. 30 is a sectional view of a mattress apparatus according to an eleventh embodiment of the present invention.

FIG. 30 shows an eleventh embodiment of the invention. This is a modification of a bottom cushion body and an upper cushion body. Namely, the mattress apparatus 101A of this embodiment uses a bottom foamed elastic body 181 and upper foamed elastic body 182, which are made of soft or semi-hard foamed elastic material and shaped to be a square plate with a specified thickness, instead of the spring unit used in the first embodiment.

A holding groove 183 is formed in the full length of the periphery of the foamed elastic body 182. A U-shaped movable rod member 122 is provided at both end portions of the longitudinal direction of the holding groove 183. A pair of movable rod members 122 is different in the length in the longitudinal direction of the upper foamed elastic body 182.

A fixed straight rod member 123 is provided at the middle portion, in the longitudinal direction, on both sides of the upper foamed elastic body 182. At both ends of the fixed straight member 123, both ends of the pair of movable rod members 122 are connected by the hinge mechanism 124 of the same configuration as in the first embodiment.

Thus, even in the double-cushion type mattress apparatus 101A, one end portion 101*a* and the other end portion 101*b* of the upper foamed elastic body 182 can be bent upward from the state indicated by the solid line in FIG. 30 and held as indicated by the chain line.

The bottom foamed elastic body 181 and upper foamed elastic body 182 are covered together with the exterior cloth 144, and the part of the upper foamed elastic body 182 bent upward by the movable rod member 122 is covered separately from the bottom foamed elastic body 181. The exterior cloth 144 of this embodiment is shown simplified, but has the same configuration as the exterior cloth 144 of the ninth embodiment shown in FIG. 21. The same reference numerals are given to the same components, and an explanation thereof will be omitted.

Therefore, in this embodiment, when both end portions of the upper foamed elastic body 182 are bent upward and held, the upper surface of the bottom foamed elastic body 181 and the lower surface of the upper foamed elastic body 182 are prevented from being exposed.

As a double-cushion type mattress apparatus, for example, the spring unit shown in the ninth embodiment may be combined with the foamed elastic body shown in the eleventh embodiment.

According to the invention shown in the ninth to eleventh embodiments, when the movable rod member is raised at a specified angle, one end portion and the other end portion of the upper cushion body can be bent upward and held by the movable rod member. Thus, the user's head and legs can be held raised.

Further, by rotating a movable rod member connected to a fixed rod member by a hinge mechanism, one end portion and the other end portion of the cushion body can be raised. This permits application to the upper cushion body of a double-cushion type mattress apparatus, and realizes a simple configuration compared with a conventional raising mechanism.

What is claimed is:

1. A mattress apparatus in which a user places a head on an upper surface of one end portion of the mattress apparatus in a longitudinal direction thereof, said mattress apparatus comprising:

a bendable cushion body;

a fixed rod member provided integrally with at least both sides, in a lateral direction, of a periphery of the cushion body;

a hinge mechanism including a pair of fitting parts which are movably connected and releasably held at an angle, a first one of the fitting parts being fixed to an end portion of the fixed rod member;

a movable rod member which is connected to a second one of the fitting parts of the hinge mechanism and is provided together with a periphery of at least one end portion of the cushion body, and which bends at least one end portion of the cushion body when moved and raised by the hinge mechanism; and an exterior cloth which covers the cushion body;

wherein the cushion body comprises a spring unit, and the fixed rod member and the movable rod member are fastened with a holding mechanism to a coil portion of a spring body placed in a periphery of the spring unit; and wherein the holding mechanism comprises a holding cloth which includes a peripheral edge that extends from the periphery of the spring unit to one of a lower surface and an upper surface of the spring unit, and the peripheral edge of the holding cloth is wound around the fixed rod member and movable rod member, and a wound portion of the holding cloth is connected and fixed to the periphery of the spring unit with a clip.

2. The mattress apparatus according to claim 1, wherein the fixed rod member comprises a straight rod provided at said both sides of the cushion body, in the lateral direction of the cushion body, and the movable rod member is connected to respective ends of the straight rods of the fixed rod member by the hinge mechanism so as to be movable up and down.

3. The mattress apparatus according to claim 1, wherein the fixed rod member and movable rod member are substantially U-shaped, and respective end portions of the U-shaped fixed rod member are connected to respective end portions of the U-shaped movable rod member by the hinge mechanism at both sides of the cushion body, in the lateral direction of the cushion body.

4. The mattress apparatus according to claim 3, wherein the movable rod member includes several parts which are sequentially connected to the fixed rod member by the hinge mechanism.

5. The mattress apparatus according to claim 1, wherein the fixed rod member and movable rod member connected by the hinge mechanism formed a rectangular frame smaller than a shape of a plane of the spring unit, and the fixed rod member and movable rod member are inserted and held between windings of a plurality of said coil portions in the periphery of the spring unit.

6. The mattress apparatus according to claim 1, wherein the cushion body comprises a foamed elastic body, and the fixed rod member and movable rod member are inserted and held in a holding groove formed in a periphery of the foamed elastic body.

7. The mattress apparatus according to claim 1, further comprising a bottom cushion body provided on a lower surface of the cushion body, the exterior cloth covers the cushion body and bottom cushion body together, and the at least one end portion of the cushion body that is bent by the movable rod member is covered separately from the bottom cushion body.

8. The mattress apparatus according to claim 1, wherein two said cushion bodies are provided side by side in the lateral direction, the exterior cloth covers the two cushion bodies together, and the at least one end portion of each of the cushion bodies that is by the movable rod member is separately covered.

9. The mattress apparatus according to claim 1, wherein the spring unit includes a plurality of said spring bodies arranged side by side in a specified direction, and each spring body includes spring portions continued by one wire with axial lines arranged substantially parallel.

10. The mattress apparatus according to claim 1, wherein the fixed rod member comprises straight rods provided on said both sides of the cushion body in the lateral direction of the cushion body, a first said movable rod member is connected via a first said hinge mechanism to ends of the straight rods at a first longitudinal end of the fixed rod member, and a second said movable rod member is connected via a second said hinge mechanism to ends of the straight rods at a second longitudinal end of the fixed rod member, such that both said movable rod members are movable in a same rising direction.

11. The mattress apparatus according to claim 10, wherein the first and second movable rod members have different lengths in a longitudinal direction of the cushion body.

* * * * *